US005259544A

United States Patent [19]

Hashimoto

[11] Patent Number: 5,259,544

[45] Date of Patent: Nov. 9, 1993

[54] AUTOMATIC DOCUMENT FEEDER CAPABLE OF FEEDING A DOCUMENT IN THE FORM OF COMPUTER FORM PAPER

[75] Inventor: Kenji Hashimoto, Tokyo, Japan

[73] Assignee: Ricoh Company, Ltd., Tokyo, Japan

[21] Appl. No.: 633,261

[22] Filed: Dec. 20, 1990

[30] Foreign Application Priority Data

Dec. 20, 1989 [JP] Japan ..... 1-329966

[51] Int. Cl.[5] ..... B65H 23/04

[52] U.S. Cl. ..... 226/43; 226/24; 226/45; 355/308; 355/316; 400/708

[58] Field of Search ..... 226/2, 36, 24, 27, 33, 226/42, 43, 45, 101, 112; 400/703, 708, 711; 355/308, 310, 316, 317, 318

[56] References Cited

U.S. PATENT DOCUMENTS 4,320,960 3/1982 Ward et al. ..... 355/75 X
4,462,527 7/1984 Taylor et al. .
4,485,949 12/1984 Gebhart et al. ..... 226/2
4,526,309 7/1985 Taylor et al. .
4,834,277 5/1989 Gomoll et al. ..... 226/101

FOREIGN PATENT DOCUMENTS 2188618 10/1987 United Kingdom .

*Primary Examiner*—Daniel P. Stodola
*Assistant Examiner*—Paul T. Bowen
*Attorney, Agent, or Firm*—Oblon, Spivak, McClelland, Maier & Neustadt

[57] ABSTRACT

An automatic document feeder (ADF) for use with an electrophotographic copier, digital copier or similar image recorder for selectively feeding ordinary documents in the form of separate sheets and a continuous document in the form of computer form (CF) paper. Sprocket holes formed through the CF paper are sensed to controllably transport and stop the CF paper on the basis of the number of sensed holes. Even when the sprocket holes are partly deformed or practically lost due to breakage, the positions where they should exist are surely sensed to control the transport and stop of the CF paper. Sensors responsive to the sprocket holes do not have to be shifted in matching relation to the width of CF paper and, therefore, eliminates the need for a complicated structure.

6 Claims, 21 Drawing Sheets

| Fig. 11A | Fig. 11B |
|---|---|

AUTOMATIC DOCUMENT FEEDER CAPABLE OF FEEDING A DOCUMENT IN THE FORM OF COMPUTER FORM PAPER

BACKGROUND OF THE INVENTION

The present invention relates to an automatic document feeder (ADF) for use with an electrophotographic copier, digital copier or similar image recorder for selectively feeding ordinary documents in the form of separate sheets and a continuous document in the form of computer form (CF) paper.

An ADF is extensively used with the above-described kind of image recorder for automatically feeding a document to a glass platen of the image recorder while preventing it from jamming the path or from being damaged, then stopping it on the glass plate, and then discharging it after an image printed thereon has been scanned. Documents usable with the ADF include ordinary documents in the form of separate sheets and elongate documents such as CF paper. Generally, CF paper has a number of sprocket holes formed through a marginal area thereof. Specifically, the sprocket holes are positioned one after another in an intended direction of paper feed to mesh with the teeth of a sprocket which drives the CF paper. A sensor is located on the transport path of the CF paper to sense the sprocket holes. Every time a particular number of sprocket holes associated with one page are sensed, the CF paper is brought to a stop and then copied. An ADF having a capability for transporting such CF paper to the glass platen is disclosed in Japanese Patent Laid-open Publication (Kokai) No. 72455/1984. A drawback with a prior art ADF having such a capability is that once the edge of CF paper where the sprocket holes are positioned is broken or otherwise deformed, the sprocket holes themselves are deformed and cannot be accurately sensed. Then, the amount of transport of the CF paper would deviate from expected one to prevent each image area or print area of the CF paper from being reproduced with accuracy.

SUMMARY OF THE INVENTION

It is therefore an object of the present invention to provide an ADF for an image recorder which is capable of transporting CF paper by each predetermined amount even when the sprocket holes of the paper are deformed.

It is another object of the present invention to provide a generally improved ADF for an image recorder.

An ADF for an image recorder having a top open platen of the present invention comprises a document transporting device located to face the platen for transporting a continuous document constituted by a sequence of continuous pages and having a plurality of equally spaced feed holes, a plurality of hole sensors which generate feed pulses by detecting different ones of the feed holes at the same time, a decision circuit for producing, on receiving the feed pulses from the plurality of hole sensors at the same time, a feed pulse by determining that the hole sensors each has sensed a single hole, a counter for counting the feed pulses from the decision circuit, and a control circuit for controlling the document transporting device such that when the counter reaches a count matching one page of the continuous document, the document transporting device stops transporting the continuous document.

BRIEF DESCRIPTION OF THE DRAWINGS

The above and other objects, features and advantages of the present invention will become more apparent from the following detailed description taken with the accompanying drawings in which.

Figure 3:
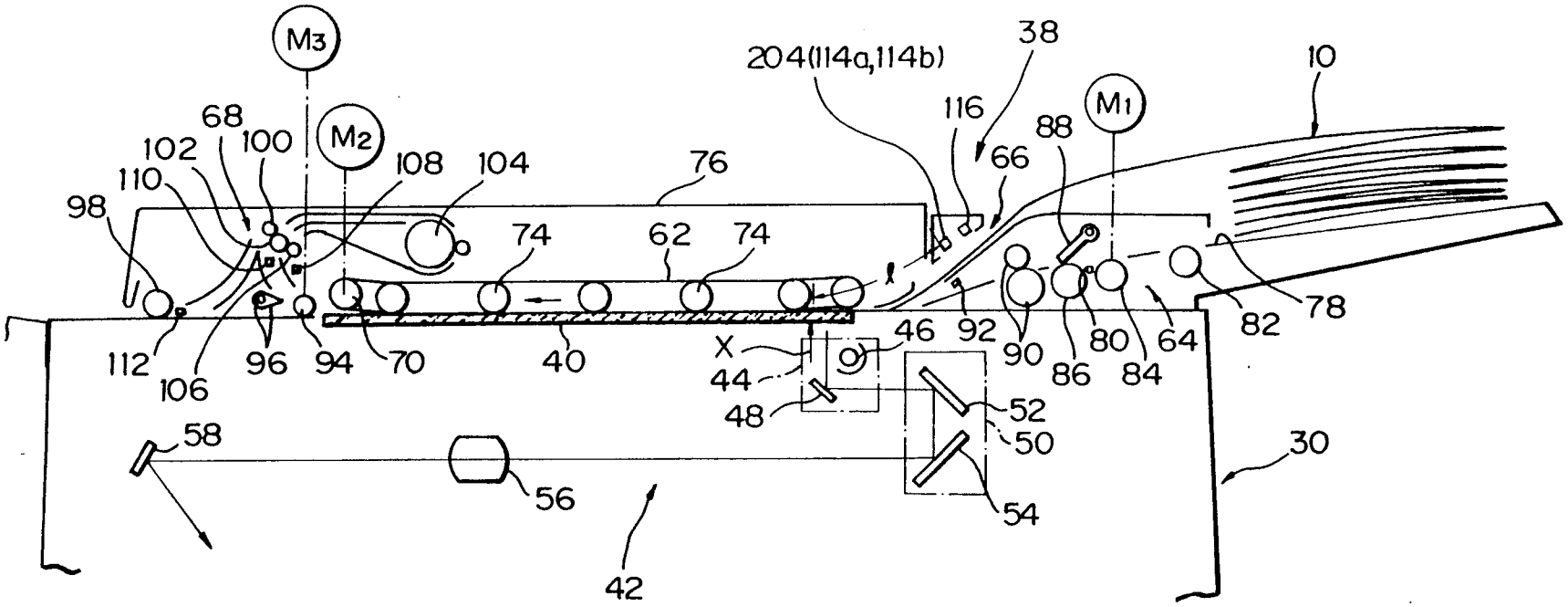
FIG. 3 is a section showing a part of the copier shown in FIG. 2 and an embodiment of the ADF in accordance with the present invention.
Figure 16:
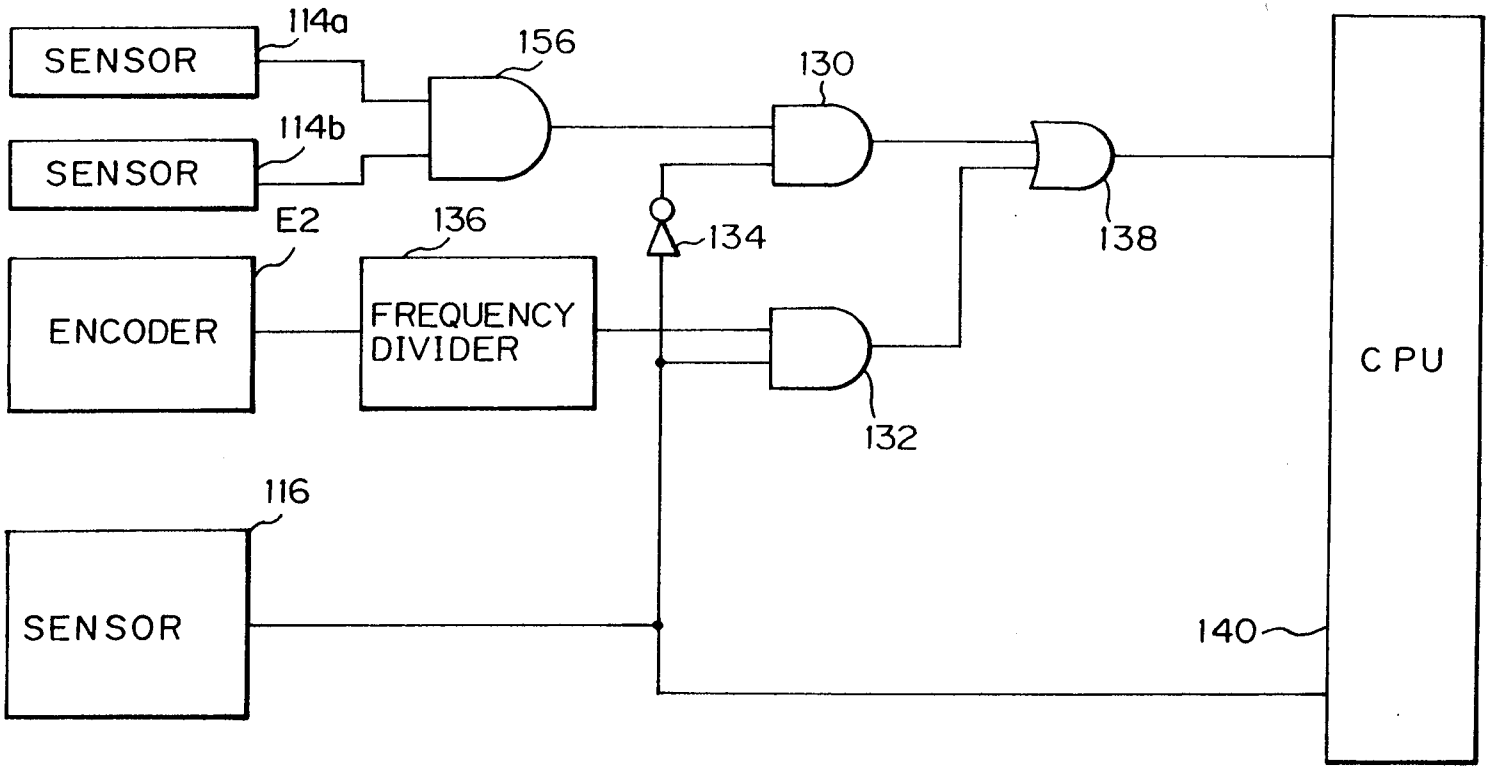
Figure 17:
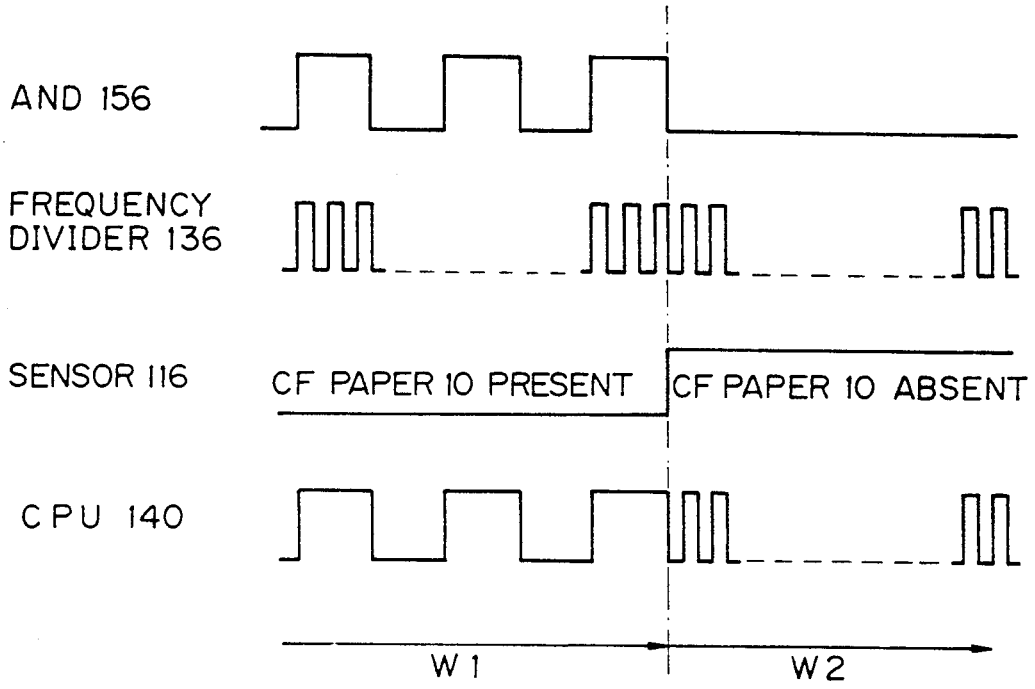
Figure 18:
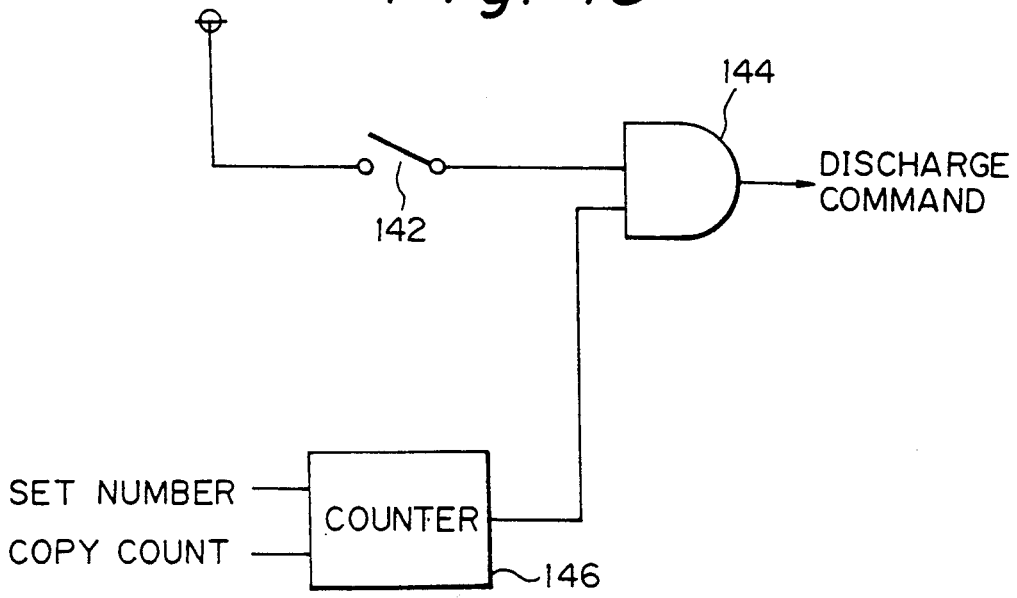
Figure 19A:
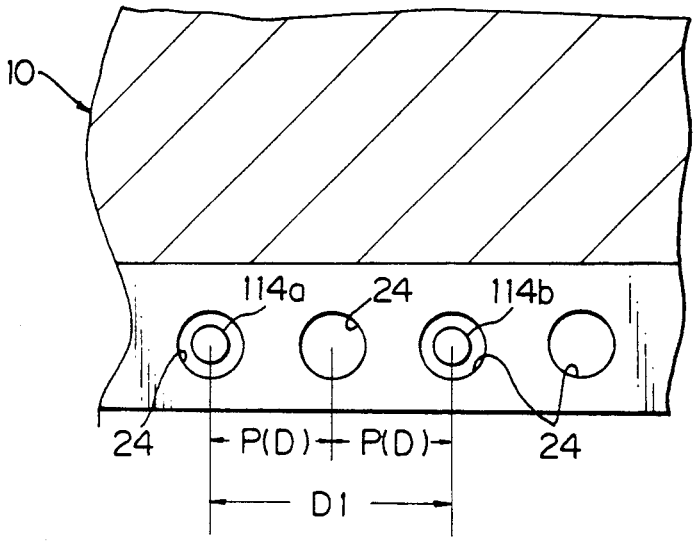
Figure 19B:
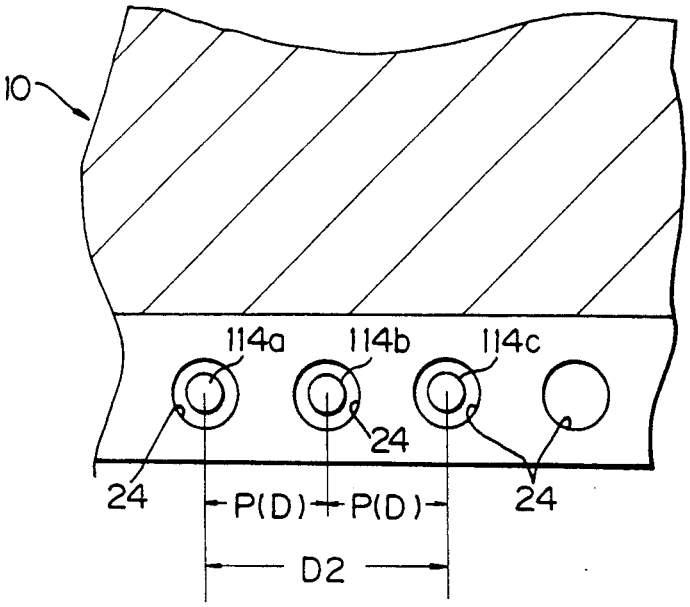

FIGS, 5A to 5C show a specific construction and operation of a control circuit associated with the ADF of FIG. 3;

FIGS. 6 through 15 are flowcharts demonstrating specific operations which are performed in a CFF mode;

FIG. 16 is a schematic block diagram showing another specific construction of a switching device;

FIG. 17 is a timing chart associated with the circuitry of FIG. 16;

FIG. 18 is a block diagram schematically showing a specific construction of a feed command generating unit; and FIGS. 19A and 19B are plan views each showing another specific positional relation between the sprocket holes and the sensors.

DESCRIPTION OF THE PREFERRED EMBODIMENT

To better understand the present invention, a prior art ADF will be outlined.

Figure 1B:
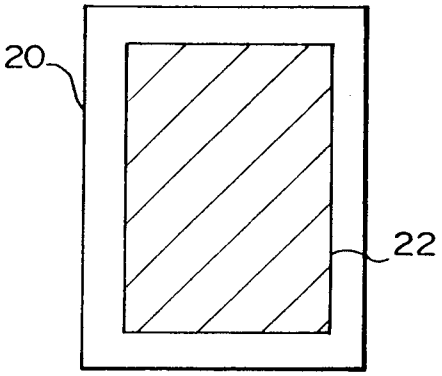
FIG. 1B shows a copy sheet on which an image is reproduced in an accurate position.
Figure 1D:
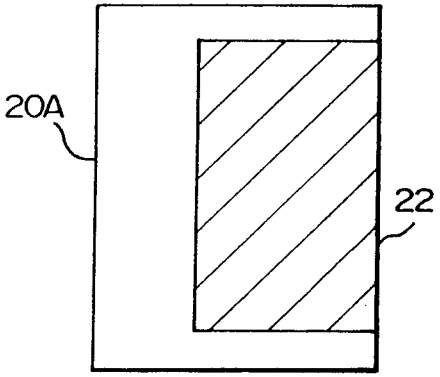
FIG. 1D shows a copy sheet on which an image is deviated from the accurate position.
Figure 1A:
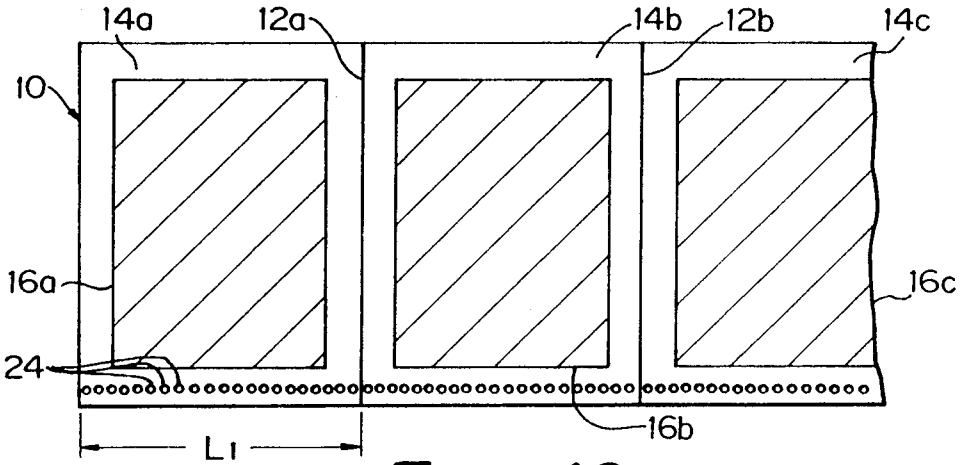
FIGS. 1A and 1C show CF paper having multiple print areas thereon.
Figure 1C:
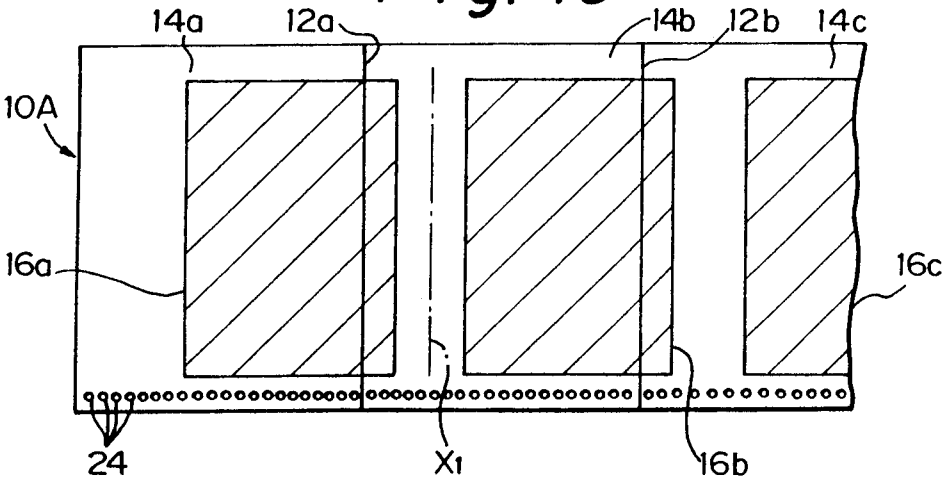

Assume an electrophotographic copier or similar image recorder on which is mounted an ADF of the type capable of feeding a document in the form of CF paper. When a document in the form of CF paper is to be copied, the ADF automatically feeds the document, the first page being the first, toward a glass platen of the image recorder via an inlet which is formed in the ADF, in exactly the same manner as with ordinary documents. After the first page has been illuminated for imagewise exposure, the CF paper is transported until the second page reaches the platen. After the second page has been stopped on the platen, it is illuminated in the same manner as the first page. In this construction, image printed on predetermined areas of individual pages of CF paper are sequentially fed page by page onto the platen to produce desired copies. Specifically, as shown in FIG. 1A, assume that CF paper 10 has image areas or print areas 16*a*, 16*b*, 16*c*, . . . which are individually accurately located in predetermined positions on consecutive pages 14*a*, 14*b*, 14*c*, . . . which in turn are delimited by folds 12*a*, 12*b*. . . Then, the print areas can be successfully copied to obtain complete reproductions, as represented by a copy 20 having an image 22 in FIG. 1B. However, it often occurs that images are not printed in predetermined positions on the consecutive pages 14*a*, 14*b*, 14*c*, . . . of the CF paper 10A, e.g., each of the print areas 16*a*, 16*b*, 16*c*, . . . extends over two nearby pages, as shown in FIG. 1C. When the prior art ADF is operated to automatically feed such CF paper 10A from the first page 14*a*, stop it in a predetermined position on the platen, and copy it, the image 22 will be partly lost on the resulting copy as represented by a copy 22A in FIG. 1D.

The above occurrence will be eliminated if the operator sets the first print area 16*a* of the first page 12A of the CF paper 10A in a predetermined position on the platen by hand, copies the first page 12A, and then activates the ADF for automatically feeding the ADF paper 10A page by page. Then, all the print areas 16*a*, 16*b*, 16*c*, . . . will be accurately reproduced on copies, as shown in FIG. 1B.

The prior art ADF has a single sensor responsive to sprocket holes 24 (FIGS. 1A and 1C) which are formed through CF paper, so that the CF paper may be automatically fed page by page. Such a prior art scheme has a problem left unsolved, as follows. Assume that the edge of the CF paper 10 where the sprocket holes 24 are located is broken and a sprocket hole 24*a* is lost, as indicated by Q1 in FIG. 1E. Then, the single sensor fails to sense the sprocket hole 24*a* and, therefore, prevents the CF paper 10 from being transported by each predetermined amount to a predetermined position on a platen. The result is the deviation of an image to be printed or the stop of the CF paper 10 due to jam detection. Besides, when an unexpected hole exists between the sprocket holes 24, when the CF paper is implemented as a stencil and formed with holes Q2 to be temporarily bound with other stencils, or when the fold between nearby pages has a split Q3, the sensor will also sense it as a sprocket hole 24. To eliminate this problem, it has been proposed to form sprocket holes in the other edge of CF paper also and use another sensor responsive to such holes, as disclosed in Japanese Utility Model Application No. 170752/1988, for example. Even this kind of scheme is not free from erroneous detection when the hole Q2 or the split Q3 mentioned above exists in opposite edges of CF paper. Moreover, when CF paper is replaced with another CF paper having a different width, the sensor has to be shift to a position matching the new CF paper. This requires a complicated construction and increases the cost.

Figure 2:
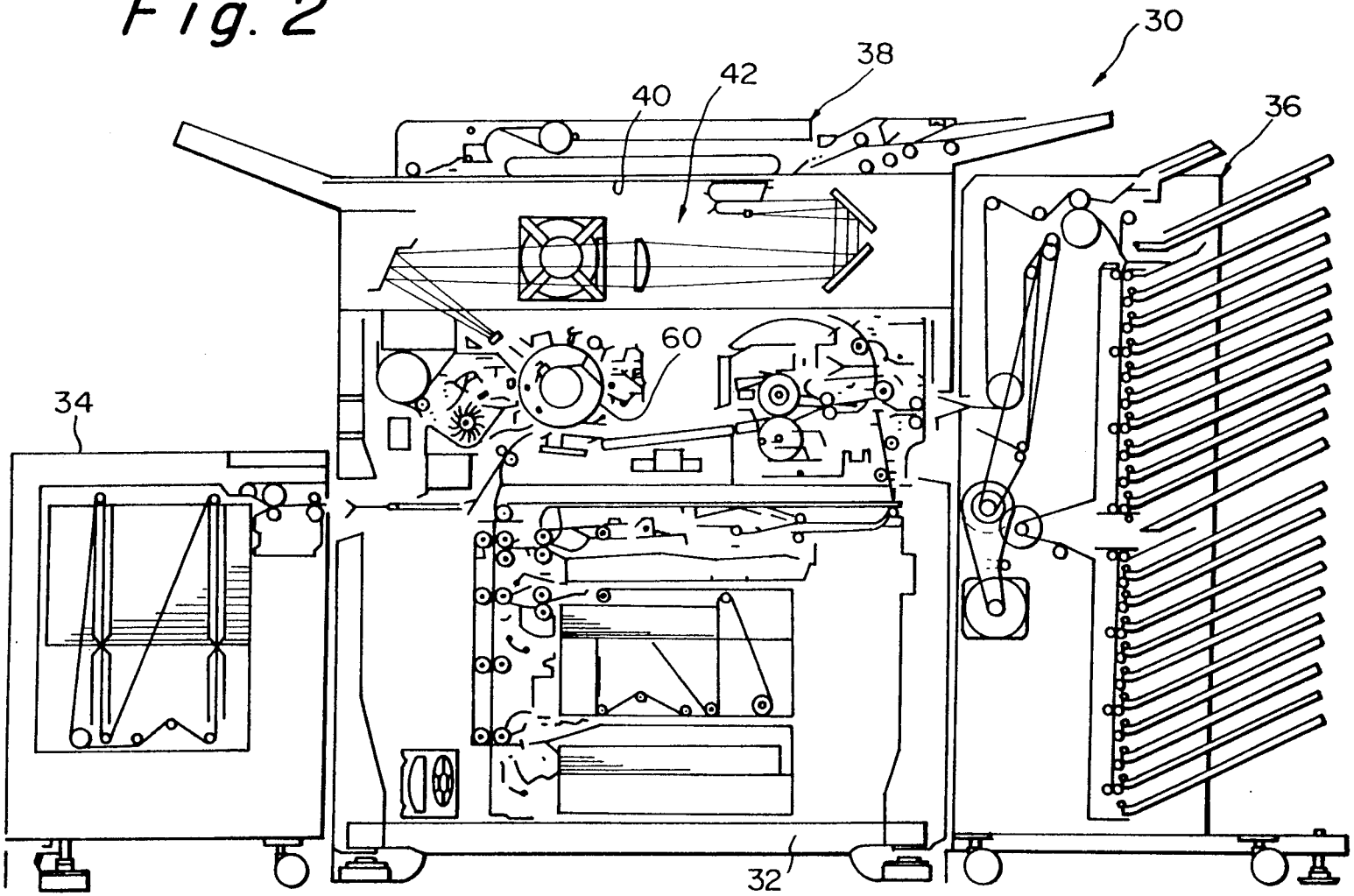
FIG. 2 is a section showing the overall construction of an electrophotographic copier which belongs to a family of image recorders to which an ADF in accordance with the present invention is applicable.

Referring to FIG. 2, an electrophotographic copier which belongs to a family of image recorders and is implemented by an embodiment of the present invention is shown. The copier, generally 30, is generally made up of a copier body 32, a mass paper feed unit 34, a sorter 36, and an ADF 38 representative of the illustrative embodiment. The copier body 32 has a glass platen 40 on which the ADF 38 is mounted for feeding a document to the glass platen 40. Optics 42 illuminates a document support surface of the glass platen 40 to reproduce a document on a paper sheet which is fed from the mass paper feed unit 34. The resulting copies are sorted by the sorter 36.

FIG. 3 shows the ADF 38 in detail. In the figure, a document fed in a specific manner as will described is laid on the glass platen 40. The optics 42 located below the platen 40 has a first scanner 44 loaded with a light source 46 and a first mirror 48, a second scanner 50 loaded with a second mirror 52 and a third mirror 54, a lens 56, and a fourth mirror 58. The scanners 44 and 50 are individually moved to the left away from their home positions shown in the figure, so that the document laid on the platen 40 is illuminate by light issuing from the light source 46. A reflection from the document is sequentially reflected by the first to third mirrors 38, 52 and 54, then propagated through the lens 56, and then reflected by the fourth mirror 58, which is fixed in place, to reach a photoconductive element 60 (FIG. 2). As a result, a latent image representative of the document is electrostatically formed on the photoconductive element 60. The latent image is developed by a conventional procedure which uses toner. The resulting toner image on the photoconductive element 60 is transferred to a paper sheet to produce a copy 20 as shown in FIG. 1B.

Referring to FIG. 3, a specific construction of the ADF 38 is shown. In the illustrative embodiment, the ADF 38 has a transport member in the form of a belt 62 which is located to face the glass platen 40. An ordinary document feed unit 64 feeds ordinary sheet documents (hereinafter referred to as ordinary documents) one by one to the platen 40. A CF paper inlet 66 is provided so that CF paper 10 may be fed toward the platen 40 via the inlet 66. A document discharge unit 68 drives a document coming out of the platen 40 after illumination to the outside of the ADF 38. The belt 62 is passed over a drive roller 70, a driven roller 72, and a number of presser rollers 74. The drive roller 70 is driven in a clockwise rotational motion by a motor M2 which is schematically shown in FIG. 3. The belt 62 is rotatable as indicated by an arrow A in the figure, transporting a document on and along the platen 40. In the illustrative embodiment, the belt 62 and the rollers over which the belt 62 is passed constitute transporting means 203, FIG. 5, which is driven by the motor M2 to transport the CF paper 10 on and along the platen 40.

A cover 76 accommodates the belt 62, rollers 70, 72 and 74 and document discharge unit 68 and is supported by the copier body 32 to be rotatable integrally with those rollers and unit. The cover 76 may be raised away from the platen 40 to access the platen 40, so that a document may be laid on the platen 40 by hand as needed.

A specific operation of the ADF 38 for causing the ordinary document feed unit 64 to feed an ordinary document automatically and an arrangement associated with such an operation will be described.

First, a main switch (not shown) of the copier 30 is turned on, and a stack of sheet documents (not shown) are loaded on a document table 78. The paper feed unit 54 has a document set sensor 80 which is turned on by the leading edges of the documents. When a print switch (not shown) of the copier 30 is pressed, the copier 30 feeds a document feed command to the ADF 38. This causes the ADF 38 begin to operate, i.e., pick-up rollers 82 and 84 of the document feed unit 64 are rotated counterclockwise to move a sheet document forward. At the same time, a separator roller 86 is rotated counterclockwise and, in cooperation with a separator blade 88 which is pressed against the roller 86 feeds only the lowermost sheet document out of the stack toward a pull-out roller pair 90. This roller pair 90 drives the sheet document toward the platen 40. The rollers 82, 86 and 90 are driven by a motor M1 which is schematically shown in FIG. 3.

As soon as the leading edge of the document fed out of the stack reaches the platen 40, the document is transported on and along the platen 40 by the belt 62 which is rotating in the direction A. When the trailing edge of the document moves away from a register sensor 92, the sensor 92 senses it. Thereafter, as the sheet document is moved by a predetermined distance, the belt 62 is brought to a halt so that the sheet document becomes stationary on the platen 40. At this instant, the trailing edge of the sheet document is located at a reference position X on the platen 40. This control is effected by an encoder E2 which is associated with the drive motor M2, as described later in detail.

Then, the scanners 44 and 50 are operated so that the document on the platen 46 is illuminated by the light source 46. This is followed by the previously mentioned sequence of copying steps. When a predetermined number of copies are produced with the above document, a CPU, not shown, of the copier 30 delivers a feed command to a CPU 118, FIG. 5A, of the ADF 38 for feeding the next sheet document, while feeding a discharge command to the CPU 118 for discharging the preceding sheet document. In response, the feed unit 64 feeds the next sheet document while, at the same time, the belt 62 is driven again in the direction A. As a result, the illuminated sheet document is driven out of the platen 40 and then out of the ADF 38 by the discharge unit 68. The procedure described above is repeated to feed the stack of documents one by one automatically.

Figure 4A:
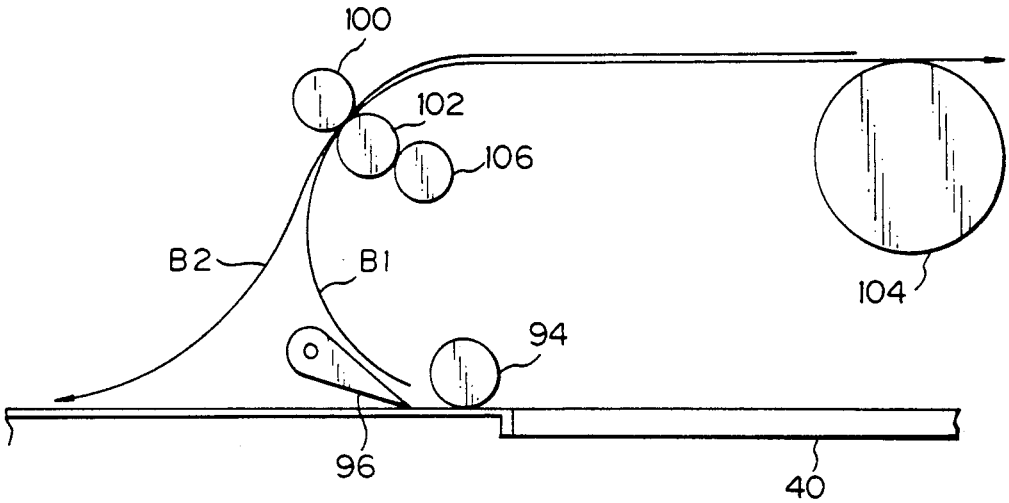
FIGS. 4A and 4B are schematic diagrams each showing a specific manner of discharging an ordinary sheet document.
Figure 4B:
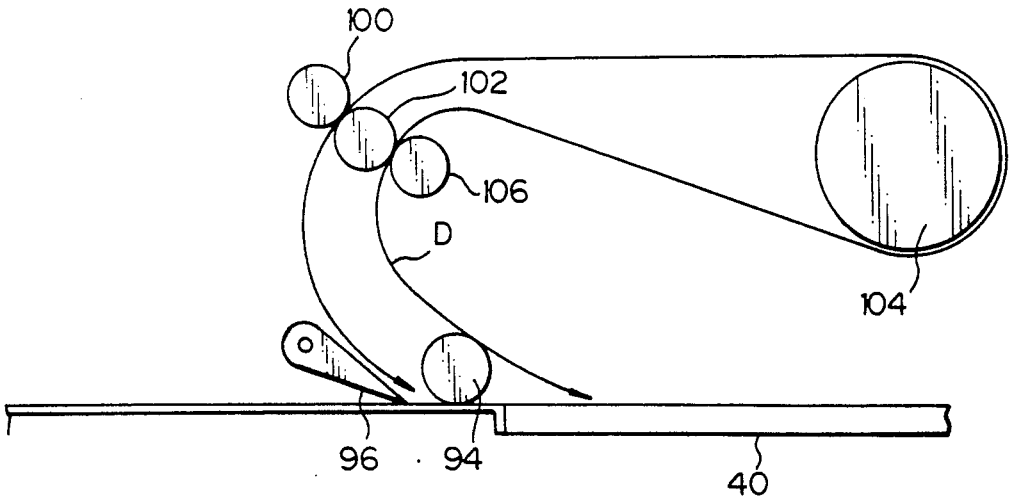

The document discharge unit 68 has an intermediate transport roller 94 which transports a document coming out of the platen 40. When the sheet document is to be directly discharged to the outside of the ADF 38, a selector pawl 96 located downstream of the roller 94 is held in a position indicated by a solid line in the figure. In this condition, the sheet document is continuously transported to the left by the roller 94 and a discharge roller 98 which is located downstream of the roller 94. When the sheet document is to be discharged face down, the selector pawl 96 is switched to a position indicated by a phantom line in FIG. 3. Then, the sheet document coming out of the platen 40 is steered by the selector pawl 96 toward a first and a second reversal rollers 100 and 102, and then further transported by the reversal rollers 100 and 102, as indicated by an arrow B in FIG. 4A. Thereupon, the rotating directions of the coactive rollers 100 and 102 are reversed to discharge the sheet document to the outside of the ADF 38, as indicated by an arrow B2 in FIG. 4A. When an image is printed on the back of the sheet document and is to be copied also, the next sheet is not fed from the feed unit 64 and, instead, the sheet document coming out of the reversal rollers 100 and 102 is transported wrapping around a turn roller 104. The sheet document is then caught by the second reversal roller 102 and a third reversal roller 106 to be thereby returned to the platen 40. This allows the image printed on the back of the sheet document to be copied. A motor M3 schematically shown in FIG. 3 is adapted to drive the above-mentioned rollers of the document discharge unit 68. A reversal registration sensor 108, a reversal inlet sensor 110 and a paper discharge sensor 112 are disposed in the illustrated positions of the discharge unit 68.

To enhance efficient copying operations, an arrangement may be so made as to begin feeding the sheet document subsequent to the document lying on the platen and, thereafter, discharge the preceding document from the platen 40. Although this causes a part of the preceding document to remain on the platen 40 when the subsequent document is brought to a halt on the platen 40, the former document is surely discharged by the intermediate transport roller 94.

The basic operation of the ADF 38 with a document in the form of CF paper will be described together with an arrangement associated therewith.

In this case, the CF paper 10, 10A shown in FIGS. 1A and 1C is inserted face down by hand in the CF paper inlet 66 which is provided independently of the document feed unit 64. So long as the print areas **16*a*, 16*b*, 16*c*, . . . are formed in predetermined positions on the CF document 10 (FIG. 1A), the first page 14*a* of the CF paper 10 is set on the platen 40 with the first fold 12*a* being held in register with the reference position X of the platen 40. As shown in FIG. 1C, when the print areas are deviated from the predetermined positions, the CF document is set on the platen 40 with the fold 12*a* being deviated from the reference position X. Specifically, the intermediate X1 between the nearby print areas 16*a* and 16*b* is held in register with the reference position X. As shown in FIG. 3, the remaining part of the CF paper 10 may be folded and laid on the table 78** or any other suitable place.

The manipulation stated above is easy to perform because the cover 76 can be raised to expose the platen 40.

After the CF paper 10 has been set on the platen 40 by hand, the cover 76 is closed and, then, the main switch and print switch of the copier 30 are pressed. Then, the CPU of the copier 30 delivers a feed command to the CPU 118 of the ADF 38. However, none of the belt 62 and discharge unit 68 operates in response to the feed command and, therefore, the CF paper 10 remains stationary on the platen 40, as described in detail later. While the CF paper 10 is held in a halt on the platen 40, the first print area **16*a* is reproduced by the previously described procedure to produce a desired number of copies 20 shown in FIG. 1B. As the illumination of the first print area 16*a* is completed, the CPU of the copier 30 delivers a discharge command to the ADF 38. In response, the motors M2 and M3 (FIG. 3) are energized to move the belt 62 in the direction A while starting driving the rollers of the discharge unit 68. Specifically, the CPU of the copier 30 sends a feed command to the CPU 118 of the ADF 38. In response, the CPU 118 feeds a transport command to servo motor circuits 124 and 126 which are a specific form of motor driving means 202, FIG. 5B, for driving the motors M2 and M3, whereby the motors M2 and M3 are driven. The motors M2 and M3 in turn cause the transport belt 62 and document discharge unit 68 to convey the CF paper 10. In this manner, the CPU 118 plays the role of feed command generating means 200, FIG. 5B**.

At the time of transport of the CF paper 10, the selector pawl 94 is continuously held in the solid-line position of FIG. 3 so that the CF paper 10 is transported horizontally by the intermediate roller 94 and discharge roller 98. Consequently, the print area **16*b* on the second page of the CF paper 10 is transported toward the platen 40**.

Figure 4C:
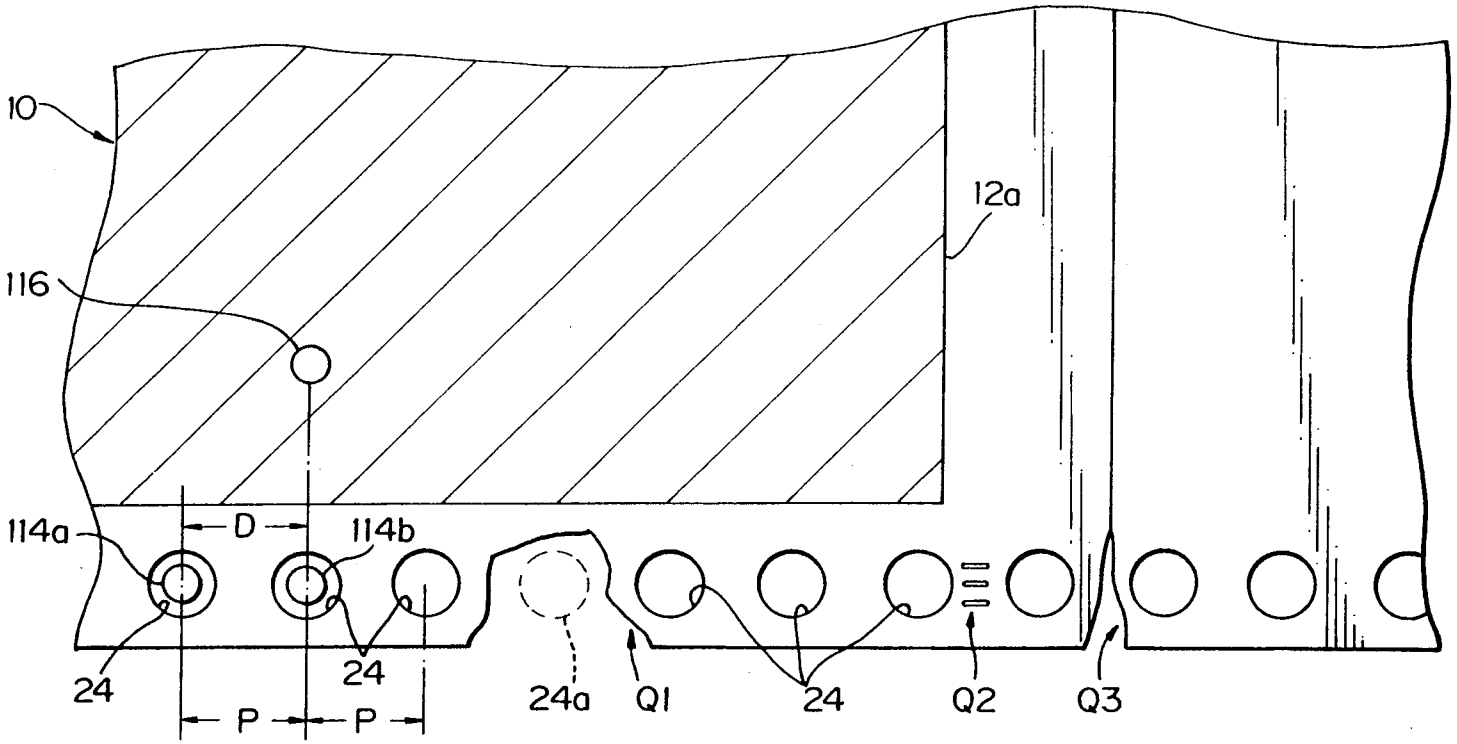
FIG. 4C is a plan view showing a positional relation between sprocket holes and sensors.

To control the transport of the CF paper 10 as stated above, sprocket hole sensing means 204 (see FIGS. 3 and 5 also) responsive to the sprocket holes 24 is fixed in place on the paper transport path upstream of the platen 40, i.e., between the inlet 66 and the platen 40 in the illustrative embodiment. The sensing means 204 is constituted by a plurality of sensors which sense different sprocket holes 24 located along one edge of the CF paper 10 at the same time. In the embodiment, as shown in FIGS. 3 and 4C, a first and a second sensor 114*a* and 114*b* are disposed above the sprocket holes 24 and at spaced locations in the direction of paper transport. The distance D between the sensors 114*a* and 114*b* are equal to the pitch P of the sprocket holes 24. Further, a sensor 116 serving as paper sensing means determines whether or not the CF paper 10 exists in a position where it can be sensed by the sensing means 204. Hereinafter, the sensor 116 and the sensors 114*a* and 114*b* will be referred to as a paper sensor and sprocket sensors, respectively. As shown in FIG. 4C, the paper sensor 116 is aligned with the sprocket sensor 114*b*, for example, in the direction perpendicular to the paper transport direction (perpendicular to the sheet surface of FIG. 3). The distance l between the position where the sensors 114*a*, 114*b* and 116 sense the CF paper 10 and the reference position X is selected to be equal to or smaller than the length $L_1$, FIG. 1A, of one page of the paper 10. The sensors 114*a*, 114*b* and 116 each may comprise a light emitting element implemented by a light emitting diode and a light-sensitive element implemented by a phototransistor. The light emitting element and light sensitive element may be so arranged as to emit light toward the CF paper 10 and receive a reflection from the paper 10 or to emit and receive light at opposite sides of the paper 10, as will be described specifically with reference to FIG. 4E.

Guide members (not shown) are disposed along the transport path between the document inlet 66 and the platen 40 for the purpose of guiding the opposite edges of the CF paper 10 which is apt to be fed askew, but members for driving the CF paper 10 are not provided there.

As the CF paper 10 begins to be transported after the reproduction of the first page 16*a*, the sprocket sensors 114*a* and 114*b* each senses a sprocket hole 24 of the CF paper 10. The resultant outputs of the sensors 114*a* and 114*b* are applied to the CPU 118, FIG. 5A, and counted by a counter built in the CPU 118. In a strict sense, the holes which are determined to be the sprocket holes 24 are counted by ANDing means which will be described. At the instant when the number of output pulses of the sensor 114*a* and 114*b* reaches a predetermined number matching one page of the CF paper 10, the motors M2 and M3 are deenergized by a command from the CPU 118 via the servo motor circuits 124 and 126 to stop the movement of the CF paper 10. At this time, the second print area 16*b* of the CF paper 10 has been located in the predetermined position on the platen 40. Assuming that the number of the sprocket holes of the CF paper is N, N is usually 22. In this condition, the print area 16*b* is illuminated to produce a copy. When a desired number of copies are produced with the print area 16*b*, the CF paper 10 is driven again by the previously discussed manner until the third print area 16*c* reaches the predetermined position on the platen 40. The print areas 16*a*, 16*b*, 16*c*, . . . are sequentially copied with the CF paper 10 being controlled on the basis of the outputs of the sprocket hole sensors 114*a* and 114*b* with respect to transport and stop.

Figure 5A:
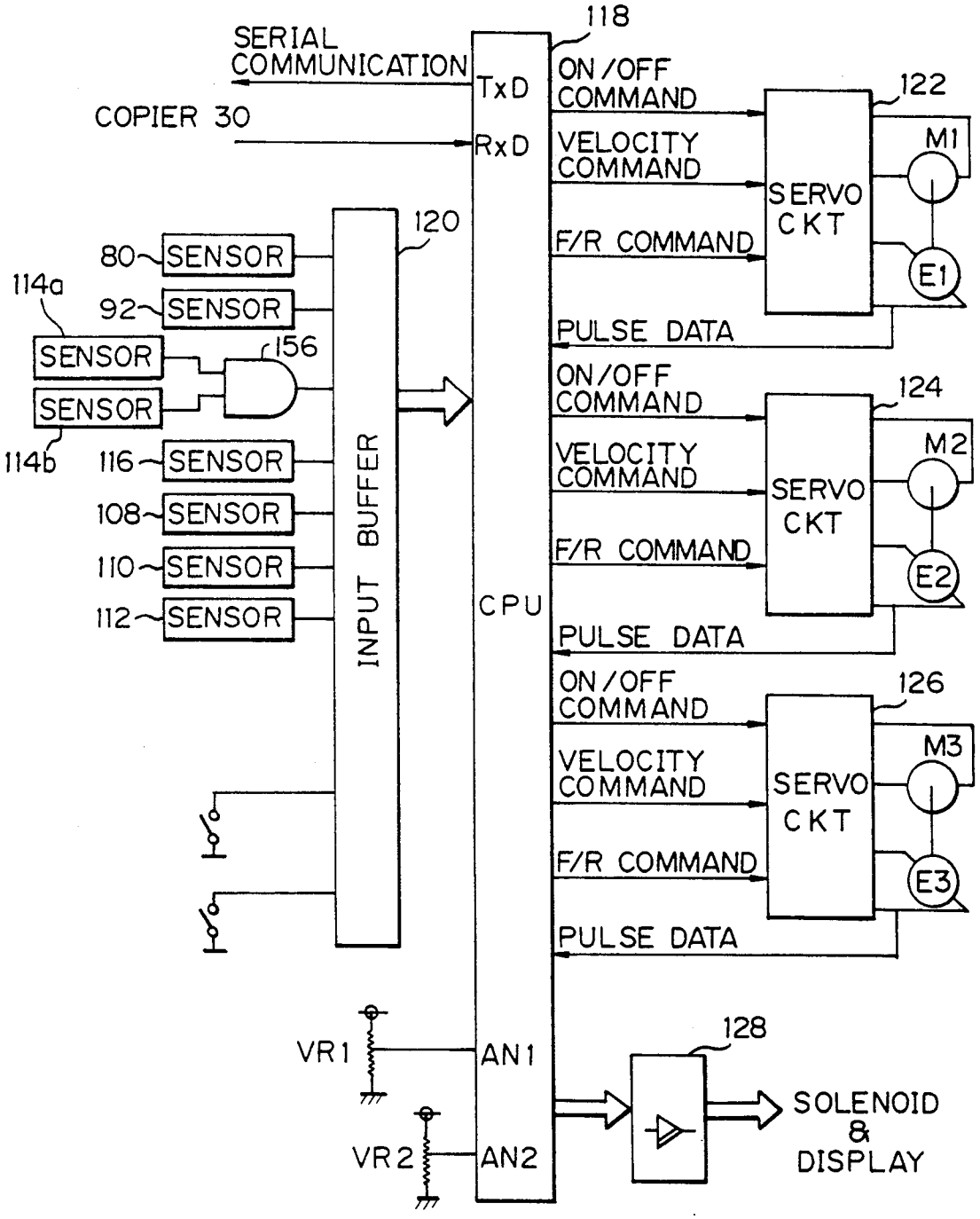
Figure 5B:
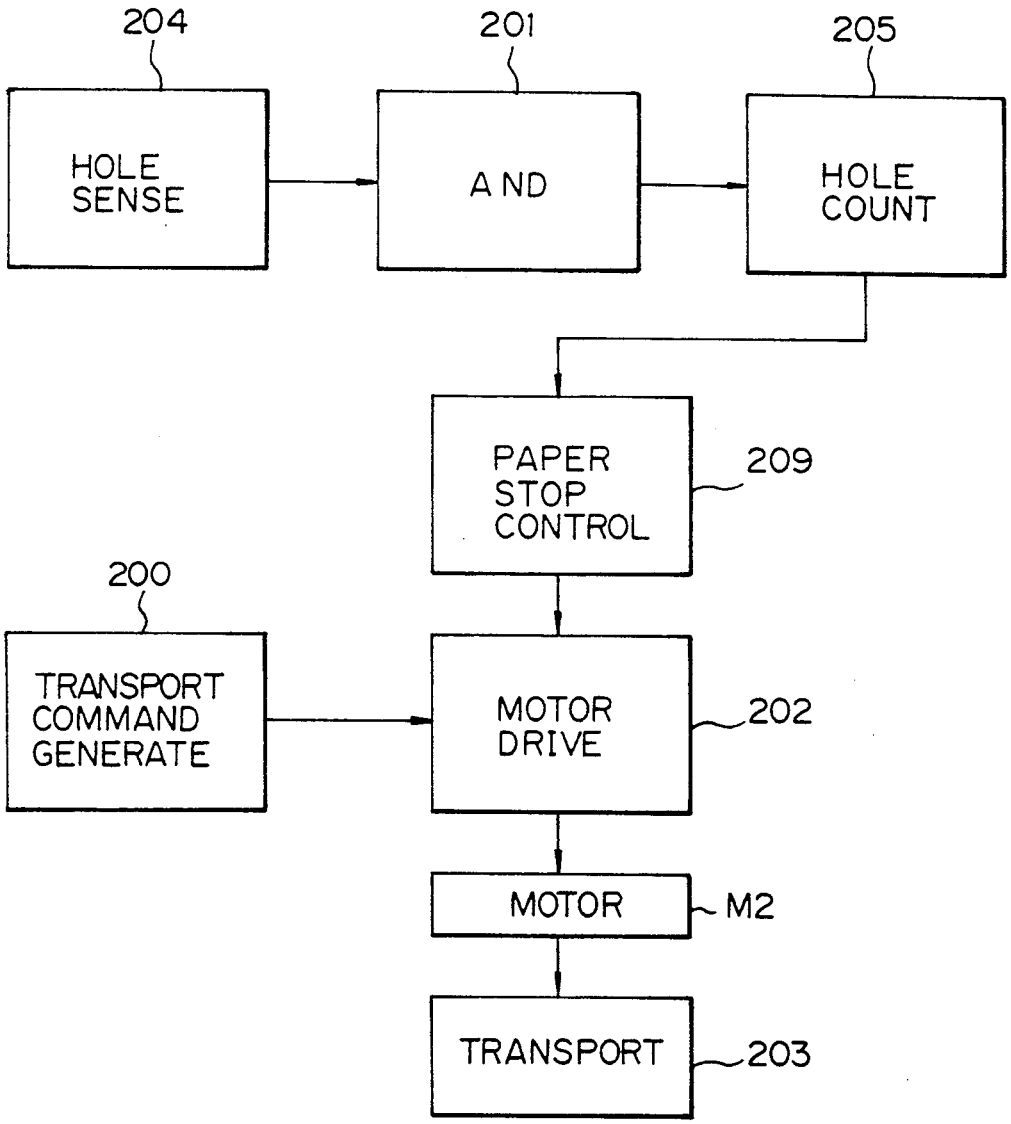

As stated above, while the paper sensor 116 senses the CF paper sheet 10, the hole counting means 205, FIG. 5B, constituted by the counter of the CPU 118 counts the sprocket holes 24 having been sensed by the sprocket sensors 114*a* and 114*b*. When the count reaches N corresponding to one page, DF paper stop control means 209, FIG. 5B, stops the rotation of the motor M2 via the servo motor circuit 124, FIG. 5A, and thereby causes the CF paper 10 into a halt.

The sprocket sensors 114*a* and 114*b* are located upstream of the platen 40. Hence, when the trailing edge of the last page of the CF paper 10 moves away from the sensors 114*a* and 114*b*, the sensors 114*a* and 114*b* cannot sense the sprocket holes 24 any more. In this condition, the transport and stop of CF paper 10 cannot be controlled. In the light of this, at the time when the paper sensor 116 stops sensing the CF paper 10 and the resultant signal is applied to the CPU 118, the control based on the outputs of the sensors 114*a* and 114*b* and an AND gate 156 (see FIGS. 4E and 5A) is interrupted, and instead paper displacement sensing means senses the displacement of the CF paper 10. The displacement sensing means is constituted by an encoder E2 associated with the motor M2 and the CPU 118. Specifically, the counter of the CPU 118 counts output pulses of the encoder E2 and thereby determines the displacement of the CF paper 10. The output pulses of the encoder E2 may be divided by a frequency divider 136 and then applied to the CPU 140, if desired (see FIG. 16).

While the CF paper 10 is transported to position the last print area thereof at the predetermined position on the platen 40, the paper sensor 116 stops sensing the paper and the resultant output is fed to the CPU 118. In response, calculating means substracts the number of sprocket holes 24 having been outputted by the AND gate 156 after the start of transport of the CF paper 10 from N which is the number of sprocket holes 24 corresponding to one page. Specifically, assuming that the number of sprocket holes 24 having been outputted by the AND gate 156 is x, the calculating means performs a subtraction N−x. After the paper sensor 116 has stopped sensing the CF paper 10, the displacement of the paper 10 being sensed by the displacement sensing means will in due course coincide with a displacement corresponding to the above-mentioned reference N−x. Then, the paper stop control means 209 stops the rotation of the motor M2 via the motor driving means 202 (servo motor circuit 124), while stopping the motor M3 in exactly the same manner. As a result, the CF paper 10 is brought to a stop.

Figure 5C:
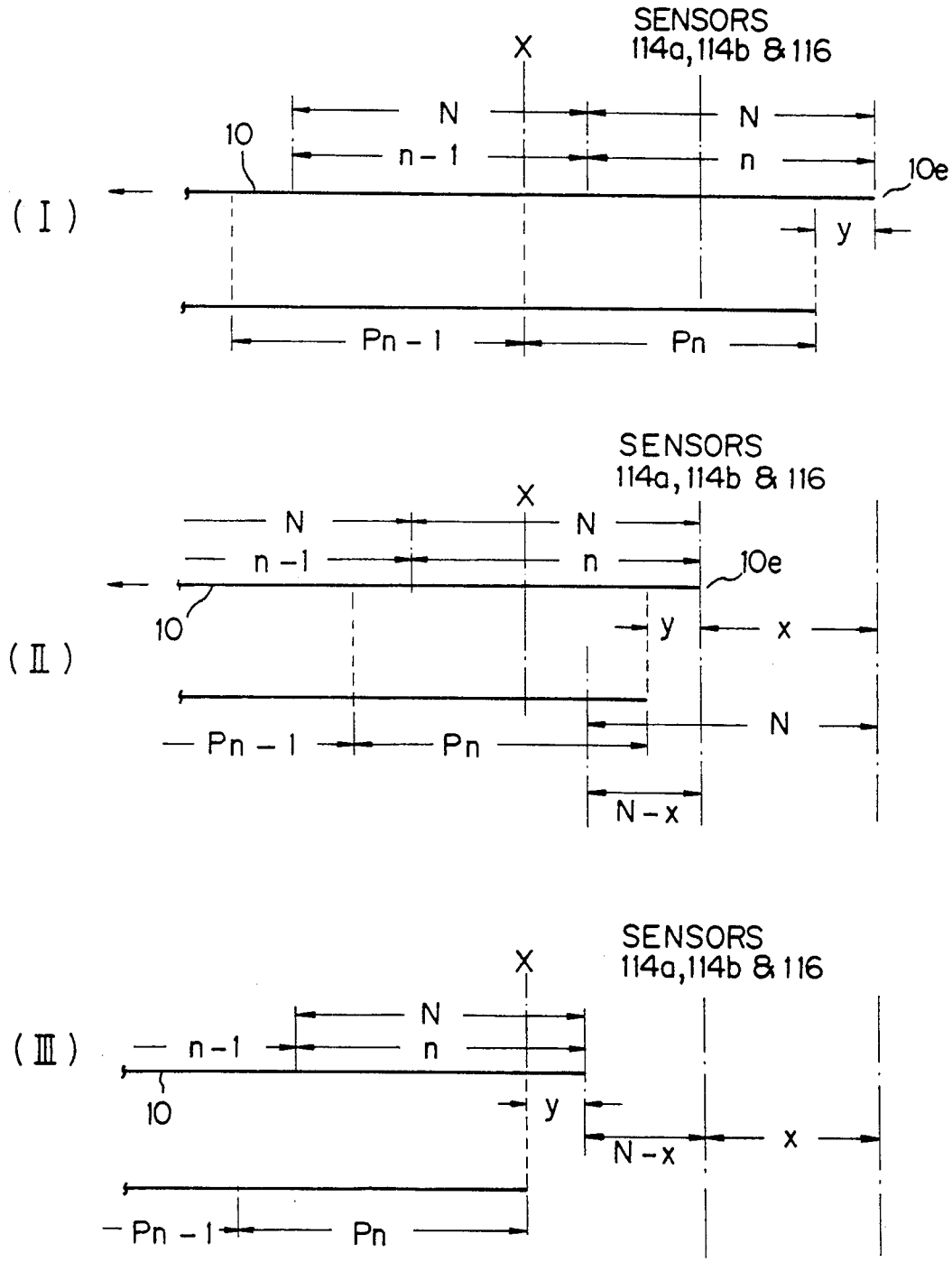

Specifically, in FIG. 5C, (I), n and n−1 are representative of the last page of the CF paper 10 and the immediately preceding page, respectively. Assume that the CF paper 10 carries the last print area Pn and the immediately preceding print area Pn−1. In this example, the print areas Pn and Pn−1 each extends over two consecutive pages, so that a substantial blank area y is left between the last page Pn and the trailing edge 10*e* of the CF paper 10. In FIG. 5C, (I), the print area Pn−1 is located in the predetermined position on the platen 40 as defined by the reference position X. When the print area Pn−1 is fully copied, the CF paper 10 is moved to the left as indicated by an arrow while the sprocket holes 24 thereof are sensed by the first sensor 114 and counted by the CPU 118. As shown in FIG. 5C, (II), at the instant when the trailing edge 10*e* moves away from the paper sensor 116, the paper sensor 116 stops sensing the CF paper 10. Assuming that the number of sprockets 24 sensed during the interval between the start of transport of the CF paper 10 and the time shown in FIG. 5C, (II), i.e., the number of pulses outputted by the AND gate 156 is x, then the CPU 118 produces a difference between the number x and the number N, i.e. N−x.

On the other hand, at the time shown in FIG. 5C, (II), the paper displacement detecting means 208 starts detecting the displacement of the CF paper 10. Specifically, the CPU 118 counts the output pulses of the encoder E2 associated with the motor M2. When the count of the encoder output pulses coincides with the displacement of the CF paper 10 corresponding to N−x, the CPU 118 determines that the trailing edge of the last print area Pn is in register with the reference position X, as shown in FIG. 5C, (III). Then, the CPU 118 (paper stop control means 209, FIG. 5B) stops the rotation of the motor via the servo motor circuit, thereby causing the CF paper 10 into a halt. More specifically, it is when the count of the output pulses of the encoder E2 coincides with N−x multiplied by a constant a that the CPU 118 stops the rotation of the motor. The constant a is representative of the number of output pulses of the encoder E2 corresponding to the pitch of the sprocket holes 24. For example, assuming that the counter of the CPU 118 counts six encoder output pulses while the CF paper 10 is moved by one pitch between nearby sprocket holes 24, then the constant a is 6. When the counter counts (N−x)×a encoder output pulses after the paper sensor 116 has stopped sensing the CF paper 10, the paper 10 is brought to a stop in the position shown in FIG. 5, (III).

The number of sprocket holes 24 counted by the sprocket sensors 114*a* and 114*b* and AND gate 156 is effected by the deviation of the print area relative to the CF paper 10. Nevertheless, whatever the deviation is, the above-described construction allows the last print area Pn to be accurately positioned and stopped at the predetermined position on the platen 40. After the last print area Pn has been copied, the CF paper 10 is driven out of the ADF 38.

In FIG. 5A, the CPU 118 of the ADF 38 which interchanges data with the CPU of the copier 30 by serial communication. These CPUs each has a RAM and a ROM there inside. The outputs of these sensors 80, 92, 114A, 114*b*, and 116 as well as the outputs of other various sensors disposed in the discharge unit 68 are fed to the CPU 118 via an input buffer 120. Of course, the sprocket sensors 114*a* and 114*b* are connected to the CPU 118 via the AND gate 156. The motors M1 and M2 and the motor M3 for driving the rollers of the discharge unit 68 are respectively driven via servo circuits 122, 124 and 126 to which the CPU 118 delivers motor ON/OFF commands, motor velocity commands (6-bit data), and forward/reverse direction commands. A solenoid for actuating the selector pawl 96, a display and so forth are driven by a driver 128 in response to commands which are also driven by a driver 128 in response to commands which are also fed from the CPU 118. The servo circuits 122, 124 and 126 use output pulses of encoders E1, E2 and E3 of their associated motors M1, M2 and M3 for the velocity controlling pulse, while feeding pulse data to the CPU 118. The CPU 118 controls the position of the document on the basis of the incoming pulse data. A part of the pulse data is used to sense errors which may occur in the motors M1, M2 and M3.

The CPU 118 has analog ports (e.g. μPD 7810 available from NEC). Variable resistors VR1 and VR2 are connected to analog ports AN1 and AN2, respectively. The resistance values of the variable resistors VR1 and VR2 are fed to the CPU 118 at a resolution of "256" to implement the control over the document stopping position. Such a configuration is successful in compensating for some scattering among ADFs. Specifically, assuming that in a certain ADF the number of pulses appearing from the instant when a sheet document moves past the register sensor 92 to the instant when it reaches the reference position X (FIG. 3) is 640, the variable resistor VR1 may be so adjusted as to produce such a number of pulses. In the software aspect, the adjustment may be made by using 600 pulses as a fixed value and adding the analog value of the variable resistor VR1 to 600.

Figure 1E:
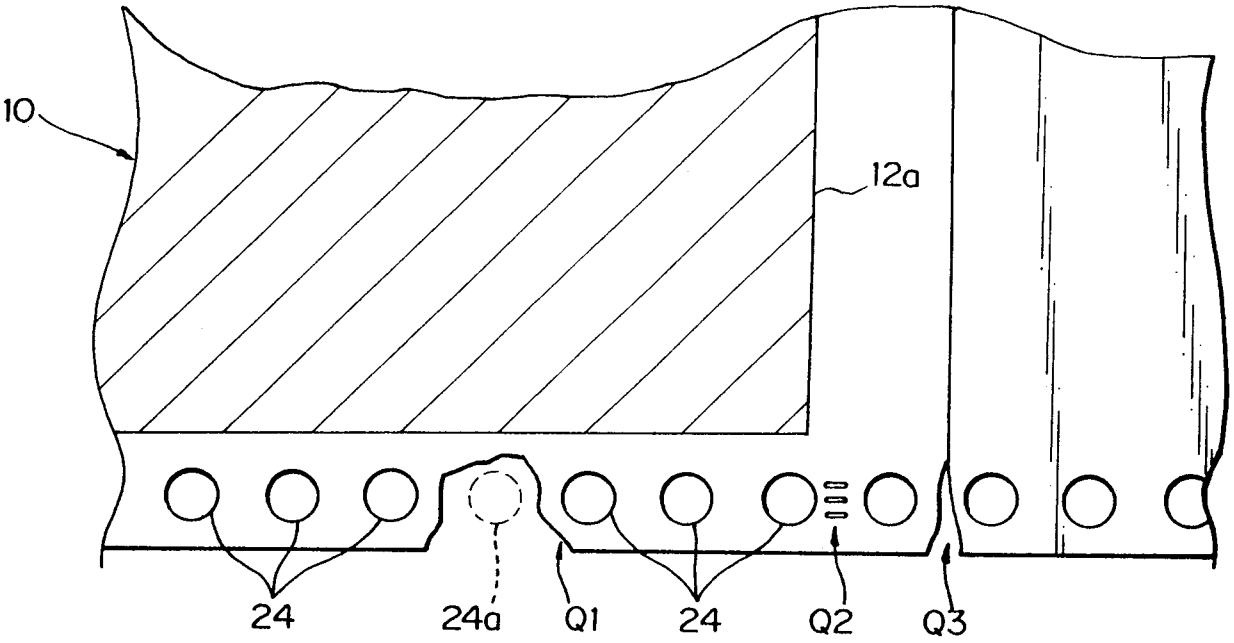
FIG. 1E shows a specific condition wherein the edge of CF paper where sprocket holes are formed is damaged.
Figure 4D:
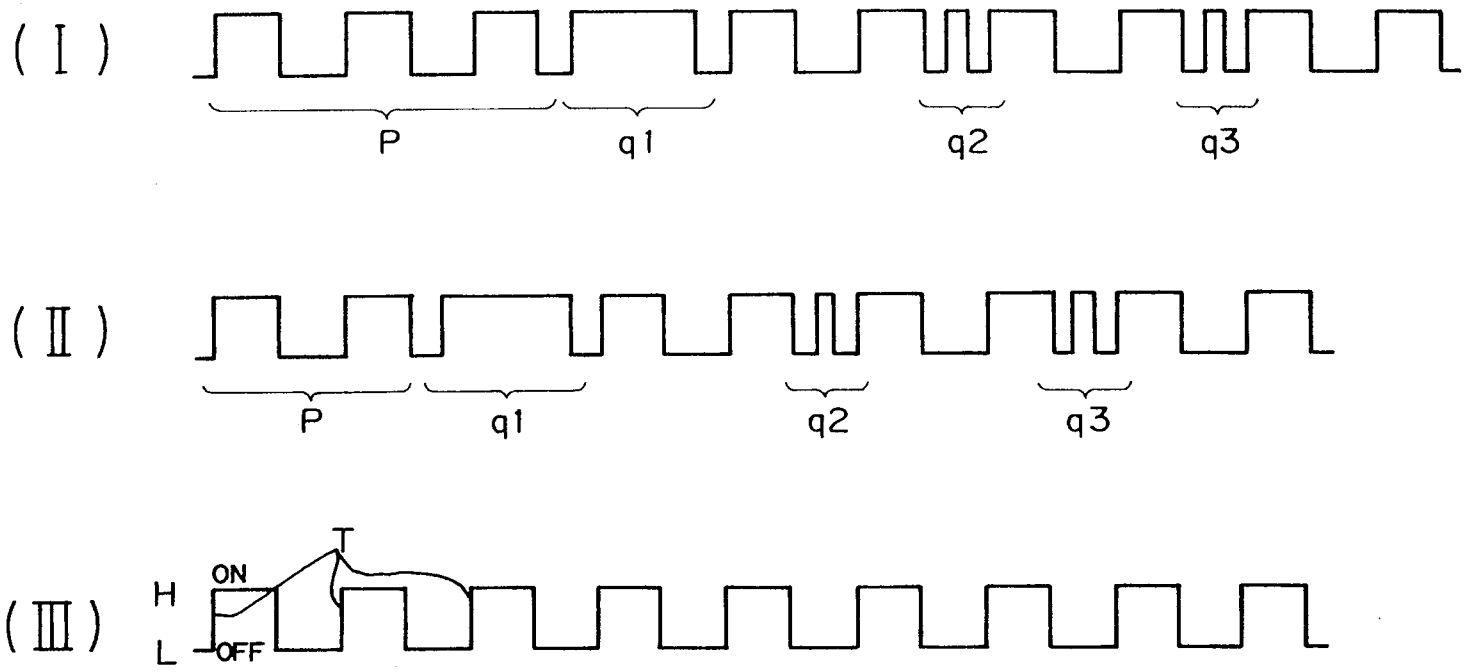
FIG. 4D shows specific waveforms representative of the outputs of the sensors.

While the prior art ADF senses sprocket holes 24 by a single sensor as stated earlier and, therefore, has the drawback discussed with reference to FIG. 1E, the illustrative embodiment uses two spaced sprocket sensors 114*a* and 114*b* and causes them to sense different sprocket holes 24 at the same time. FIG. 4D, shows specific waveforms I and II of the outputs of the sensors 114*a* and 114*b*, respectively. So long as the sprocket holes 24 are not deformed and no unexpected holes and splits exists between nearby holes 24, the outputs of the sensors 114*a* and 114*b* will have predetermined waveforms, as indicated by P in the figure. However, assuming that the CF paper 10 has a deformed portion Q1, FIG. 4C, the sensors 114*a* each produces an output q1. Likewise, when the paper 10 has the hole Q2 or the split Q3, FIG. 4C, the sensors 114*a* and 114*b* each produces an output q2 or q3. Since the sensors 114 and 114*b* are spaced apart by the distance D in the paper transport direction, the outputs q1, q2 and q3 each appears with a corresponding time lag.

Figure 4E:
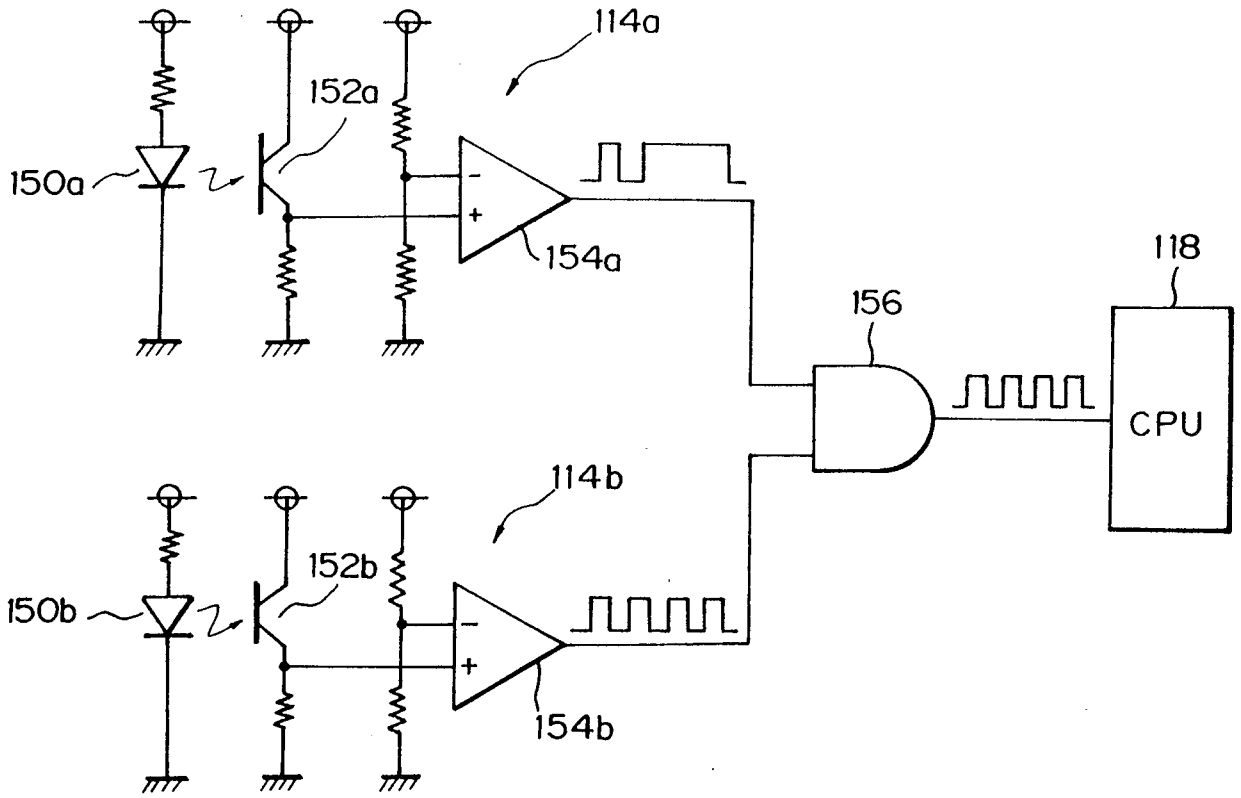
FIG. 4E is a block diagram schematically showing specific constructions of the sensors.

The outputs of the sprocket sensors 114*a* and 114*b* are applied to the CPU 118 via the AND gate 156, as shown in FIG. 4E specifically. In FIG. 4E, the sensors 114*a* and 114*b* have respectively a light emitting element 150*a* and a light-sensitive element 152*a* and a light emitting element 150*b* and a light-sensitive element 152*b*. The outputs of the light-sensitive elements 150*b* and 152*b* are respectively fed to comparators 154*a* and 154*b* to be compared with a reference voltage. The outputs of the comparators 154*a* and 154*b* are applied to the AND gate 156 whose output is in turn applied to the CPU 118. When the sensors 114*a* and 114*b* each senses a different sprocket hole 24, the AND gate 156 produces an output shown in FIG. 4D, (III). As shown, only when both of the sensors 114*a* and 114*b* are in a sensing state, it is determined that a sprocket hole 24 exists. Hence, even when the actual sprocket holes 24 are deformed or when the hole Q2 or the split Q3 exists therebetween, such an unexpected hole or split is not sensed if it does not extend over one pitch of the sprocket holes 24. More specifically, as shown in FIG. 4D, (III), the AND gate 156 produces pulses accurately representative of the sprocket holes 24 even when the CF paper 10 is damaged or otherwise deformed. The counter (hole counting means 205, FIG. 5B) built in the CPU 118 counts the output pulses of the AND gate 156, insuring accurate detection of the sprocket holes 24. When the number of sprocket holes 24 reaches N matching one page, the paper stop control means 209, FIG. 5B, constituted by the CPU 118 deenergizes the motor M2 via the servo circuit 124, or motor driving means 202, and thereby stops the movement of the CF paper 10.

The CPU 118 itself may be provided with the function of the AND gate 156, in which case the CPU 118 plays the role of ANDing means.

Hereinafter will be described specific procedures associated with the control over the transport and stop of the CF paper 10. The mode for feeding the CF paper 10 will referred to as "CFF mode" for convenience.

Figure 6:
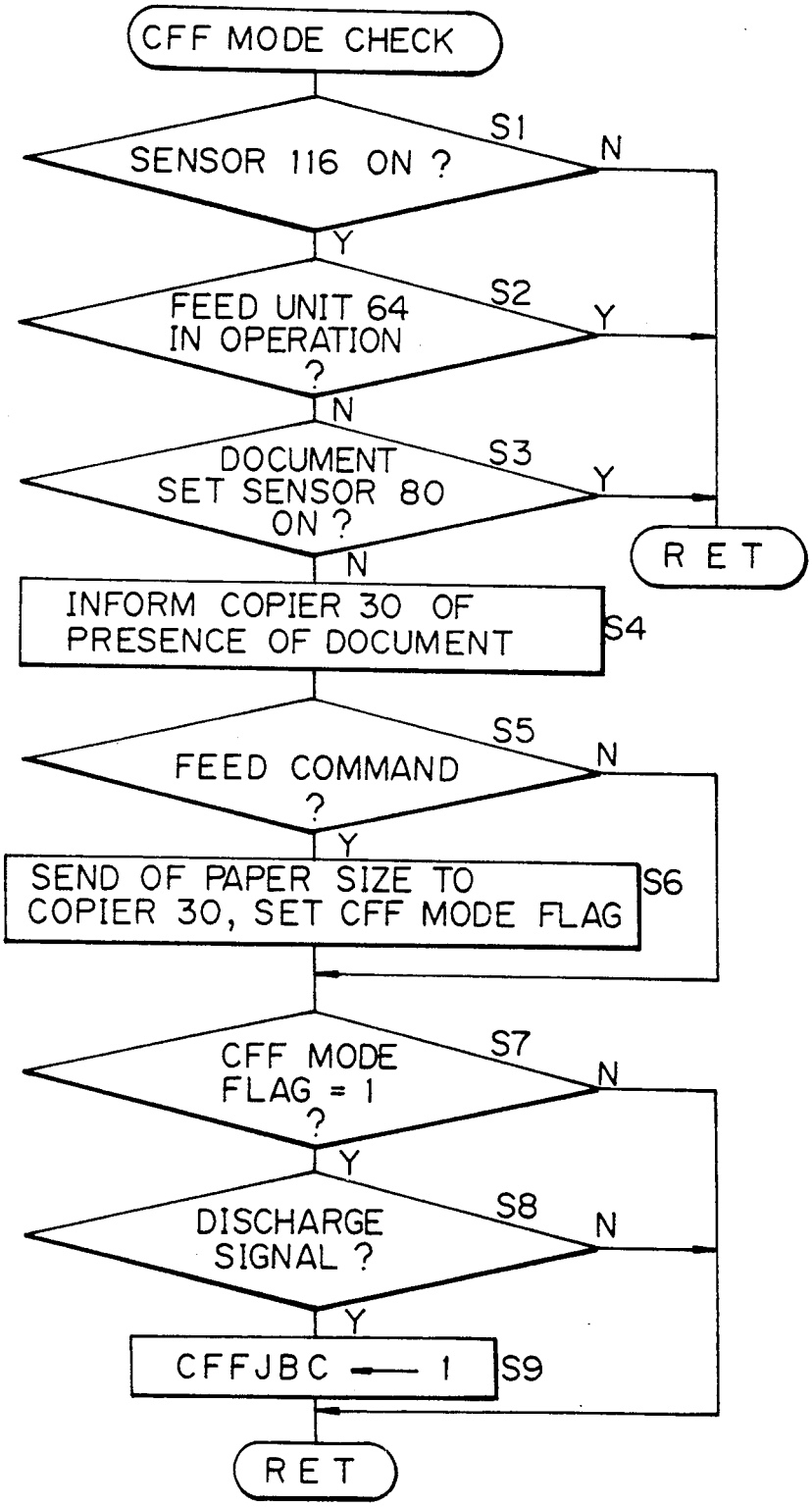

FIG. 6 shows a "CFF mode check" routine for determining whether or not the operation enters into the CFF mode. When the CF paper 10 is inserted in the inlet 66, the paper sensor 116 is turned on (step S1). In this condition, if the feed unit 64 for feeding an ordinary sheet document is not operative (S2) and if a sheet document is not laid on the table 78, i.e., the document set sensor 80 is not turned on (S3), the operation enters into the CFF mode. This indicates that the operation for feeding an ordinary sheet for copying it has priority over the operation which handles the CF paper 10. When all the above conditions are satisfied, the CPU 118 of the ADF 38 sends a command representative of the presence of a document to the CPU of the copier 30 (S4). The CPU of the copier 30 then knows that the ADF 38 is loaded with a document. When the print switch of the copier 30 is pressed, the CPU of the copier 30 sends a feed command to the CPU 118 of the ADF 38 (S5). If the document is an ordinary document, the ADF 38 will start feeding it immediately in response to the feed command. In the CFF mode, however, the feeding operation does not begin, as stated earlier; the ADF 38 sends the size of CF paper to the copier 30 in response to the feed command from the copier 30 (S6). The copier 30 uses this information for the automatic selection of paper sheets and the automatic selection of a magnification.

In response to the feed command, the ADF 38 sets a CFF mode flag (S6). This flag is adapted to determine that the CFF mode has been established. In this manner, despite the arrival of a feed command from the copier 30, the ADF 38 seemingly does not operate in the CFF mode. The copier 30, therefore, does not have to discriminate an ordinary sheet document and the CFF paper 10, achieving a simplified control arrangement. Of course, the ADF 38 may inform the copier 30 of the fact that the CF paper 10 has been set to allow the latter to perform a particular control associated with the CF paper 10.

After the set state of the CFF mode flag has been confirmed (S7), the first print area 16*a* of the CF paper 10 is illuminated for the purpose of producing a copy. After the illumination, the copier 30 sends a discharge command to the ADF 38 for instructing the latter to discharge a copied document (S8). In response, the ADF 38 loads CFFJBC (CFF job counter) with 1 (one) in order to perform an operation for transporting and stopping the CF paper 10 (CFF job) (S9). A sequence of operations which follows the step S9 will be described with reference to FIGS. 8 to 15 later.

Figure 7:
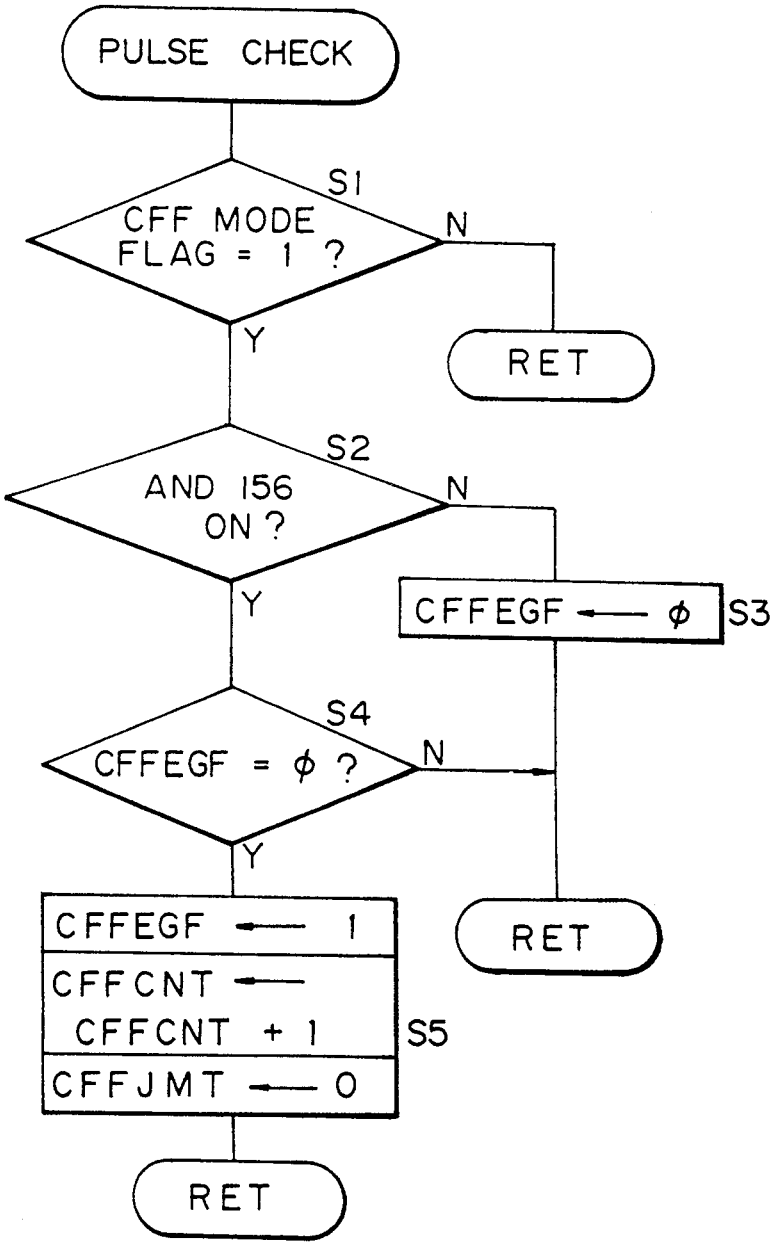

FIG. 7 shows a "CFF pulse check" routine which begins with a step S1 for determining whether or not the CFF mode flag is set. If it is set, whether or not the sprocket sensors 114*a* and 114*b* are turned on is determined (S2). Specifically, whether the output pulse of the AND gate 156 is in an ON state (high level) indicating that the sensors 114*a* and 114*b* have sensed sprocket holes 24 or in an OFF state (low level) as shown in FIG. 4D, III, is determined. If the sensor output of the AND gate 156 is in an OFF state, CFFEGF (CFF edge flag) is reset (S3). If the output of the AND gate 156 is in an ON state, whether or not CFFEGF is set is determined (S4) and, if it no set, it is set (S5). At the same time, CFFCNT (hole counting means) of the CPU 118 counts the sprocket holes 24 which are sensed by the sprocket sensors 114*a* and 114*b* (S5). Further, a counter (or timer) CFFJMT responsive to jams of the CF paper 10 is cleared, as described in detail later.

As shown in FIG. 7, the counter CFFCNT counts a sprocket hole 24 and the counter or timer CFFJMT is cleared, each at the leading edge of a sprocket hole 24. More specifically, they occur at the positive-going edge T of a pulse shown in FIG. 4, (III). Hence, even if the output of the AND gate 156 is in an ON state, the operations represented by the step S5 in FIG. 7 are not executed when CFFEGF is set, i.e., such operations are performed at the positive-going edge of a pulse without exception. By such a procedure, the sprocket holes 24 are counted on the basis of the output pulses of the AND gate 156.

FIGS. 8 to 15 show what kind of operations occur in association with the count of the CFF job counter CFFJBC.

Figure 8:
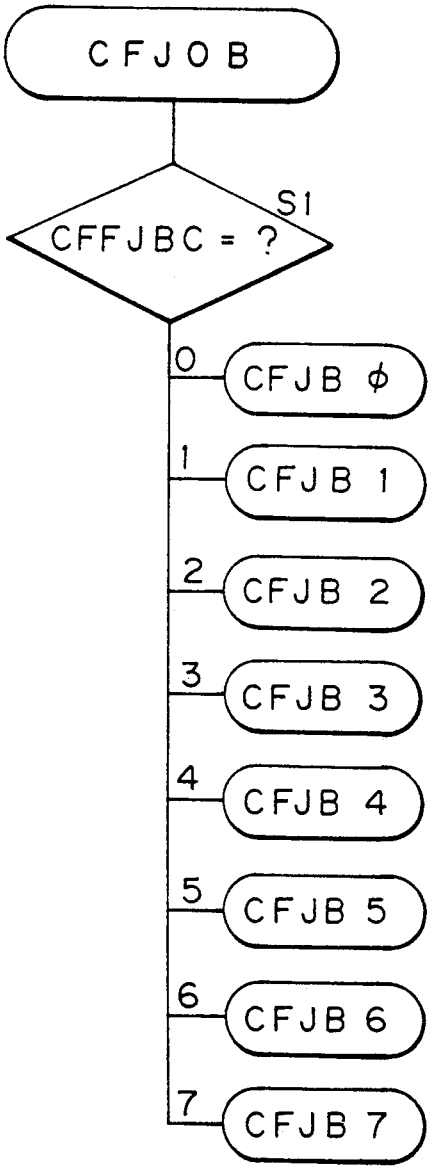
Figure 9:
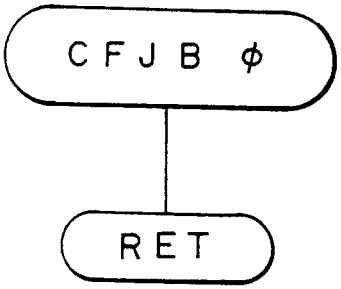
Figure 10:
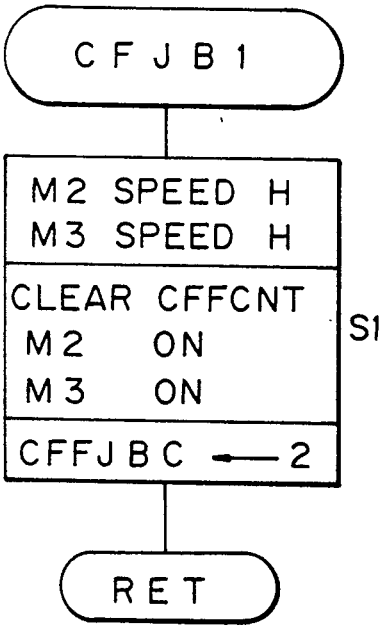

As stated with reference to FIG. 6, when the CPU 118 of the ADF 38 receives a discharge signal (S8, FIG. 6), CFFJBC is set to "1" so that multi-jump occurs on the basis of a "CFJOB" routine shown in FIG. 8 and the count of CFFJBC. If CFFJBC is "1", the program jumps to a "CFJB1" routine shown in FIG. 10. In this routine, the velocity commands associated with the belt drive motor 62 and the discharge unit drive motor M3 are so selected as to set up a high speed state H, and the motors M2 and M3 are energized via the servo circuits 124 and 126. At the same time, the counter CFFCNT responsive to the output pulses of the AND gate 156 is cleared, and CFFJBC is loaded with "2" (S1, FIG. 10). By such a procedure, the CF paper 10 is transported so that its first page begins to be discharged from the platen 40.

Figures 11, 11A:
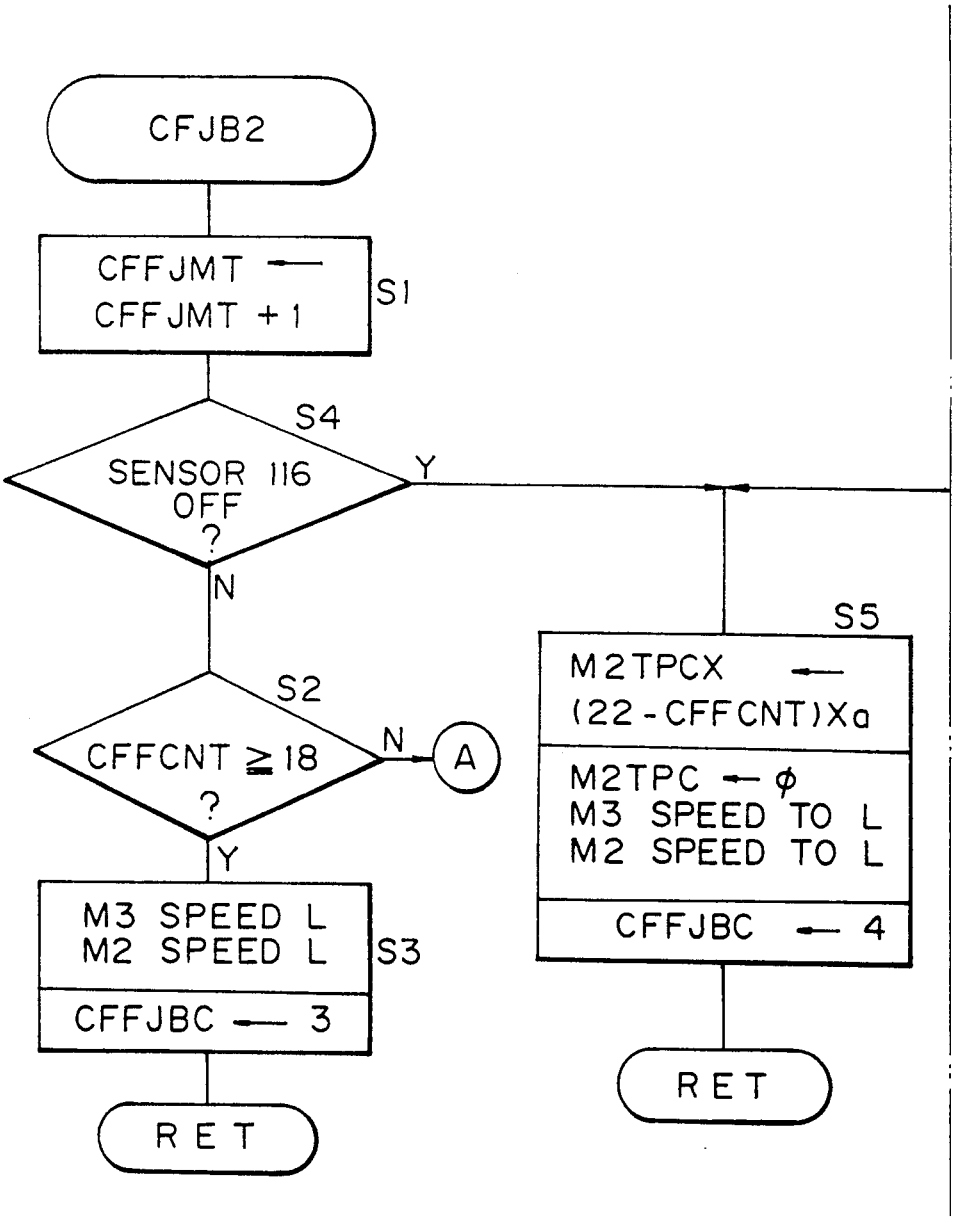
Figure 11B:
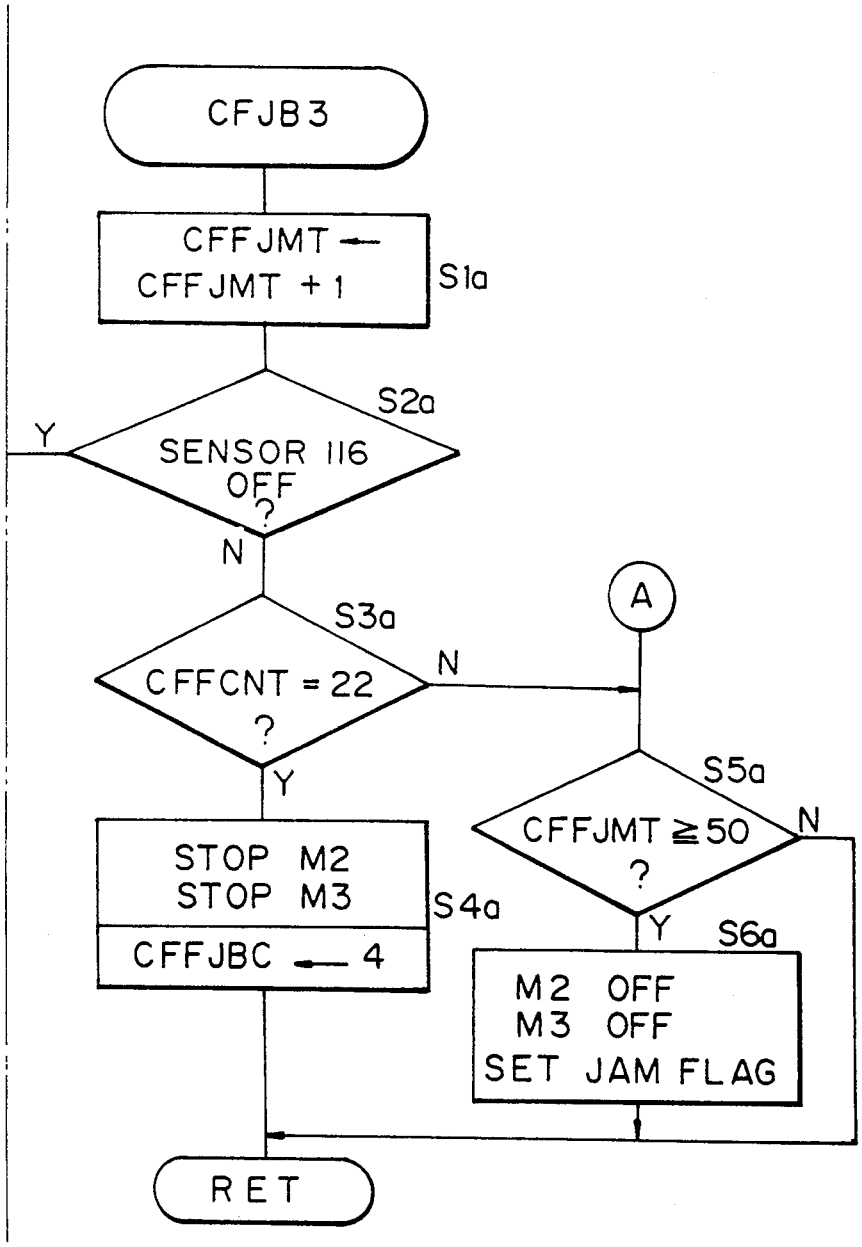

As CFFJBC is incremented to "2" (see FIG. 8 also), "CFJB2" shown in FIG. 11 is executed on the basis of the multi-jump of "CFJOB". Every time the program enters into this routine, the jam counter CFFJAMT is incremented (S1, FIG. 11), as will be described also. When the count of the counter CFFCNT has reached a predetermined value which is smaller than N, the velocity of each motor M2 and M3 is switched from high H to low L and, at the same time, CFFJBC is incremented to "3" (S2 and S3). In the illustrative embodiment, it is assumed that one page of CF paper 10 is 11 inches long, and twenty-two sprocket holes 24 are formed per page. The above operation is executed when eighteen sprocket holes 24 are counted. Switching the rotation speed of the motors M2 and M3 from high to low before one page of the CF paper 10 is fully transported as mentioned above is successful in causing the paper 20 to stop at the predetermined position accurately. What occurs when the count of CFFCNT is less than eighteen as determined in the step S2 of FIG. 11 and when the counter CFFCNT is smaller than 18 will be described later.

As the CFJB becomes "3" (see FIG. 8 also), CFFJMT is incremented, as shown in FIG. 11 and as will be described (S1*a*). When the counter CFFCNT counts up twenty-two sprocket holes representative of one page (S3*a*), the motors M2 and M3 are braked to stop them rapidly. In this manner, the motors M2 and M3 are stopped by a command from the CPU 118 via the servo circuits 124 and 126. After this processing, CFFJBC is loaded with "4" (S4*a*).

Figure 12:
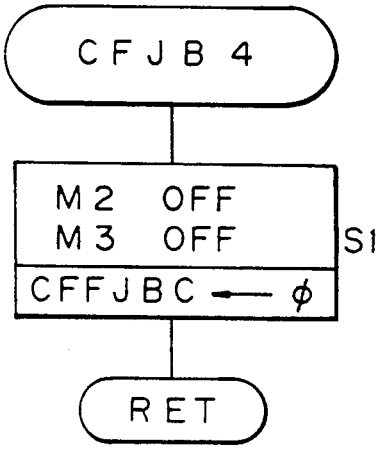

As shown in FIG. 12, in a "CFJB4" routine, the CF paper 10 is stopped, the ON/OFF commands for the motors M2 and M3 are turned from ON to OFF, and CFFJBC is reset to "0" (S1).

By the above sequence of steps, the second print area 16*b* of the CF paper 10 is set in the predetermined position on the platen 40 and then copied. Then, the operations described above are repeated.

In the steps S4 and S2*a* of FIG. 11, the turn-off of the paper sensor 116 responsive to the CF paper sheet 10 indicates that the trailing edge of the last page of the paper 10 has moved away from the sensor 116. Then, the output pulses of the AND gate 156 would fail to control the transport and stop of the CF paper 10. In such a condition, the transport and stop of the CF paper 10 is controlled by using the encoder E2, FIG. 5A, which is associated with the drive motor M2 and plays the role of paper displacement sensing means. Specifically, the control is automatically handed over from the counter CFFCNT to the encoder E2, as effected by the CPU 118. When the paper sensor 116 is turned off as determined in the steps S4 and S2*a* of FIG. 1, the number of pulses for stopping the last print area (Pn, FIG. 5C) at the predetermined position on the platen 40 is calculated. Specifically, the number x of sprockets 24 having been counted during the transport of the CF paper 10 (value of counter CFFCNT) is subtracted from the number N (22 in the embodiment) corresponding to one page, and the resulted difference N−x (22−CFFCNT) is multiplied by the constant a to produce M2TPCX (step S5, FIG. 11), as stated earlier. The constant a is the value of M2TPC (counter of CPU 118 for counting encoder E2 output pulses) which corresponds to one pitch of the sprocket holes 24. Again, a will be "6" when the counter M2TPC reaches "6" on the transport of the CF paper 10 by one pitch. More specifically, the counter M2TPCX is loaded with the number of pulses representative of an amount of feed corresponding to the count M2TPC. After such a calculation, the counter M2TPC is cleared, the rotation speed of the motors M2 and M3 is lowered to the speed L, and CFFJBC is set to "5" (step S5, FIG. 11). Thereafter, the program advances to a routine "CFKB5" shown in FIG. 13. Reducing the rotation speed of the motors M2 and M3 as stated is effective to stop the CF paper 10 at the predetermined position accurately.

Figure 13:
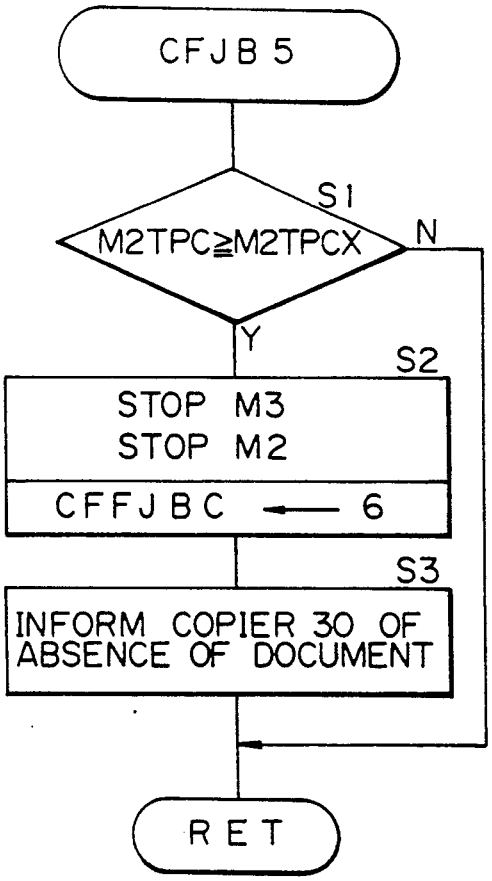

In the "CFJB5" routine, whether or not the counter M2TPC has reached a predetermined number M2TPCX is determined (S1, FIG. 13). This count is associated with the interval between the time when the counter M2TPC begins to count pulses and the time when the print area Pn of the last page of the CF paper 10 reaches the predetermined position on the platen 40. At this time, therefore, the motors M2 and M3 are rapidly braked to a stop, whereby the CF paper 10 is stopped (S2). CFFJBC is loaded with "6" (S2), and a command representative of the absence of the document is sent to the copier 30 to show the latter that the page is the last page of the CF paper 10 (S3).

Figure 14:
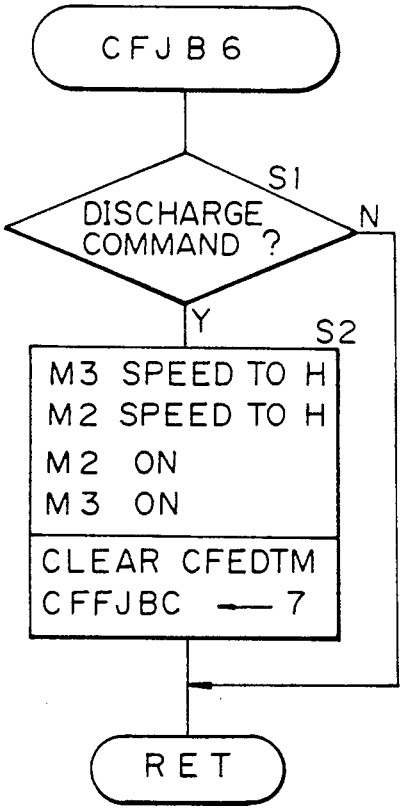

As shown in FIG. 14, in the "CFJB6" routine, in response to a discharge command sent from the copier 30 after the illumination of the last page (S1), the motors M2 and M3 are operated at a high speed H to discharge the CF paper 10 (S2). CFFJBC is loaded with "7", and a timer CFEDTM (computer form end timer) is cleared (S2).

Figure 15:
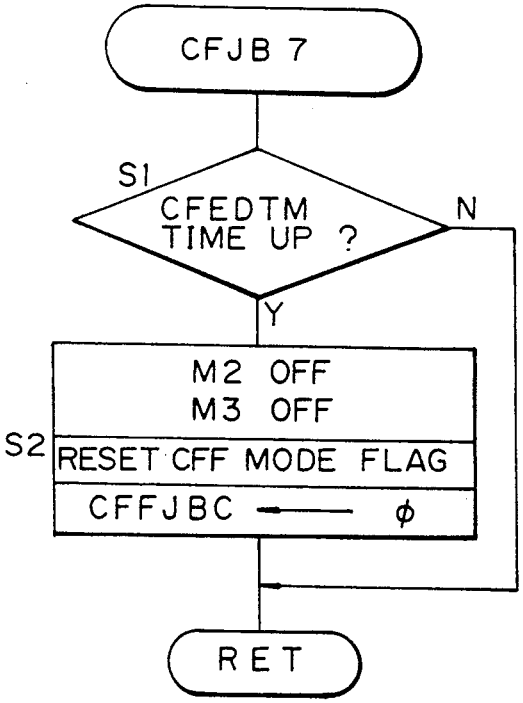

In a "CFJB7" routine shown in FIG. 15, after the time-up of the timer CFEDTM (S1), the motors M2 and M3 are deenergized, the CFF mode flag is reset, and CFFJBC is cleared to "0". This is the end of a sequence of CFF mode operations.

Concerning the overall flow, CFFJB0 to CFFJB4 are repeated so long as the CF paper 10 is continuously copied and, for the last page only, CFFJB0, CFFJB2. CFFJB2, CFFJB5, CFFJB6 and CFFJB7 are executed.

The counter CFFJMT cleared in the step S5 of FIG. 7 is incremented every time each of "CFJB2" and "CFJB3" is executed. Specifically, this counter is cleared at every positive-going edge of the output of the AND gate 156. When the counter counts a longer period of time than the interval between the positive-going edge of one pulse and the next positive-going edge with the CF paper 10 being transported without a jam, "50" in the illustrative embodiment, the program determines that the CF paper 10 has jammed the ADF 38. More specifically, in the "CFJB3" routine shown in FIG. 11, before the counter CFFCNT reaches 22 representative of one page of the CF paper 10, the counter CFFJMT is checked (S5*a*, FIG. 11). When the counter CFFJMT counts 50, the program determines that the CF paper 10 has jammed the ADF 38, deenergizes the motors M2 and M3, and sets a jam flag which is used for various kinds of jam processing (S6*a*, FIG. 11). So long as the CF paper 10 is transported without a jam, the counter CFFJMT is necessarily cleared before counting fifty pulses. For example, assume that the pitch of the sprocket holes 24 is ½ inch, and that the positive-going edge T of the output of the AND gate 156 arrives as the CPU 118 every 20 milliseconds to 30 milliseconds and counted by the counter CFFCNT. Then, CFFJMT is cleared every time it counts ten to fifteen pulses and does not reach 50 pulses. Stated another way, when a sprocket hole 24 of the CF paper 10 is not sensed for more than 100 milliseconds to 150 milliseconds, a jam is detected and, as stated previously, the motors M2 and M3 are deenergized.

The ADF 38 of the illustrative embodiment is capable of turning over an ordinary sheet document which carries images on both sides thereof for sequentially copying the images, as stated earlier. In addition, the copier 30 has a two-sided copying function available for forming images on both sides of a paper sheet. On the other hand, data are printed out only on one side of a CF paper without exception. In such a situation, when the operator desires to produce a two-sided copy by using the CF paper 10, the operator is expected to select a copy mode by manipulating keys which allow a two-sided copy to be produced from a one-sided document. However, it may occur that the operator inadvertently selects a mode which produces a two-sided copy from a two-sided document. Therefore, in order that a two-sided copy may be attained even under such a condition, an arrangement is preferably be made such that even when a document reversal command or a face-down discharge command is fed from the copier 30, the same processing as would be executed in response to a discharge signal as indicated in the step S8 of FIG. 6 is effected.

In the illustrative embodiment, the control device is constructed such that when the output of the CF paper sensor 10 representative of the presence of the CF paper 10 disappears, the page of the CF paper 10 is brought to the predetermined position on the platen 40. This allows even the last page of the CF paper 10 to be copied while being positioned on the platen 40 with accuracy.

In the illustrative embodiment, the pulse generator constituted by the encoder E2 which is associated with the motor M2 and the counter M2TPC for counting the output pulses of the pulse generator are the major components of the control device. Of course, the encoder E2 or similar pulse generator may be replaced with timer means, stated earlier. The encoder E2 may even be replaced with an encoder which is associated with the drive system for driving the belt 62 or the rollers 70, 72 and 74, for example.

As soon as the CF paper 10 on the platen 40 is fully illuminated, the copier 30 sends a discharge command to the ADF 38, as described previously. The motors M2 and M3 start operating in response to the discharge command only and thereby individually drive the belt 62 and discharge unit 69 to transport the CF paper 10. Stated another way, in the CFF mode the CF paper 10 is not transported despite the arrival of a feed command from the copier 30. This allows the first page of the CF paper 10 to be set on the platen 40 without any trouble. Should the CF paper 10 be transported in response to a feed command as an ordinary document, it would be driven out of the platen 40 before the start of reproduction of the first page resulting in a predetermined copy being not produced.

In the CFF mode, the CF paper 10 may be transported by the feed unit 64 which is adapted to feed an ordinary document. This is undesirable, however, because the feed unit 64 has a separator roller 86 and a separator blade 88 which is held in pressing contact with the roller 86. Specifically, when the CF paper 10 is driven by the separator roller 86 and blade 88, a substantial degree of friction is apt to act on the CF paper 10 to cause to latter to skew. While an ordinary document rarely skews despite the friction exerted by the roller 86 and blade 88 because it is relatively short, the CF paper 10 which has a substantial length is apt to undergo a noticeable skew as a result of accumulation of unnoticeable skews.

In the light of the above, the ADF 38 has the CF paper inlet 66 which is independent of the feed unit 64 that serves to feed an ordinary document to the platen 40. Although a transport roller pair or similar transport members for driving the CF paper 10 may be provided between the paper inlet 66 and the platen 40, so long as the first page of the CF paper 10 is set on the platen 40 by hand, the CF paper 10 can be sequentially transported by the belt 62, i.e., without resorting to such extra transport members because the first page will of course be located below the belt 62. For this reason, in the illustrative embodiment, no transport members are provided on the transport path extending between the paper inlet 66 and the platen 40. This positively cuts down the cost of the ADF 38.

In this particular embodiment, use is made of a CPU for switching the control over the transport and stop of the CF paper 10 from the sprocket sensors 114*a* and 114*b* and AND gate 156 to the encoder E2. FIG. 16 shows a specific arrangement for facilitating an understanding of such a switching device. In FIG. 17, before the trailing edge of the last page of the CF paper 10 moves away from the sensors 114*a* and 114*b*, the AND gate 156 produces pulses in associated with the sprocket holes 24 and delivers them to a second AND gate 130. On the other hand, while the paper sensor 116 senses the CF paper 10, its output has a low level and is applied to a third AND gate 132 while being routed through an inverter 134 to the AND gate 130. Output pulses of the encoder E3 associated with the motor M3 are fed to the third AND gate 132 via a frequency divider 136. The outputs of the AND gates 130 and 132 are coupled to an OR gate 138 the output of which in turn is connected to the CPU 140.

In the above configuration, the second AND gate 130 produces pulses corresponding to the output pulses of the AND gate 156 and feeds them to the OR gate 138. However, since the inverted low level output of the paper sensor 116 is fed to the third AND gate 132, the AND gate 132 does not produce AND. Hence, pulses associated with the outputs of the AND gate 156 are fed from the OR gate 138 to the CPU 140 and counted by the latter. This operation is continued over a period of time W1 shown in FIG. 17, whereby the transport and stop of the CF paper 10 is controlled.

As soon as the trailing edge of the last page of the CF paper 10 moves away from the sensors 114*a* and 114*b*, the paper sensor 116 does not sense the CF paper 10 any longer and, therefore, its output level becomes high. It follows that the output of the sensor 116 is fed to the second AND gate 130 as a low level while being fed to the third AND gate 132 as a high level. On the other hand, the output of the AND gate 156 is maintained at a low level, and the output of the encoder E2 appearing through the frequency divider 136 is applied to the third AND gate 132 as in the previously stated condition. As a result, the AND output of the second AND gate 130 disappears, and the outputs of the third AND gate 132 associated with the output of the frequency divider 136 are fed to the OR gate 138. The OR gate 138 produces the same pulses as the output pulses of the frequency divider 136 and delivers them to the CPU 140. Counting the incoming pulses, the CPU 140 controls the transport and stop of the CF paper 10. This operation is performed during a period of time W2 shown in FIG. 18.

As stated above, when the trailing edge of the CF paper 10 moves away from the sensors 114*a* and 114*b*, the control by the first sensor 114*a* and 114*b* and AND gate 156 is automatically handed over to the control by the encoder E2 by the switching device shown in FIG. 16.

It is to be noted that when the trailing edge of the last page of the CF paper 10 moves away from the paper sensor 116 and thereby goes high in level, the resultant signal is applied to the CPU 140. As a result, the counter CFFCNT responsive to the output pulse signal of the AND gate 156 is switched to the counter responsive to the output pulses of the frequency divider 136, so that the output pulses of the frequency divider 136 are counted.

After the CF paper 10 on the platen 40 has been illuminated, a discharge command is generated to operate the motors M2 and M3 for driving the CF paper 10, as stated earlier. FIG. 18 shows a specific construction of a device for so generating a discharge command. When the first scanner shown in FIG. 3 returns to its home position after fully illuminating a document laid on the platen 40, a home scanner sensor 142 shown in FIG. 18 is turned on and the resulting output is fed to an AND gate 114. While the operator enters a desired number of copies to be produced with a single document, the entered number is set on a counter 146 which is also shown in FIG. 18. As the copying operation is repeated with a certain page of the CF paper 10, the number of times that the operation is repeated is counted by a copy counter so that the counter 146 is sequentially decremented. When the counter 146 is decremented to zero, it feeds an end-of-copy signal to the AND gate 144. At this time, the home sensor 142 delivers its output to the AND gate 144 resulting in a discharge signal being produced from the AND gate 144. In response, the motors M2 and M3 begin to operate and feed the CF page 10 by one page.

In the specific arrangement shown in FIG. 4C, the sprocket sensors 114*a* and 114*b* are so positioned as to sense two nearby sprocket holes 24 of the CF paper 10. Alternatively, as shown in FIG. 19A, the sensors 114*a* and 114*b* may be spaced apart by a greater distance to sense every two or more sprocket holes 24 at the same time. FIG. 19B shows still another alternative arrangement wherein three sprocket sensors 114*a*, 114*b* and 114*c* are arranged to sense three successive sprocket holes 24 at the same time. When all of the three sensors 114*a*, 114*b* and 114*c* are in a sensing state, the AND gate 156 produces AND to determine that a sprocket hole 24 exists.

When the number of sprocket sensors is increased or the distance between the sprocket holes 24 to be sensed thereby is increased, the sprocket holes 24 can be surely detected even if the breakage or the split of the CF paper 10 extends over the distance D1 or D2. For example. when the sensors 114*a* and 114*b* are located to sense every two sprocket holes 24, as shown in FIG. 19A, it is possible to sense the sprocket holes 24 accurately even if the breakage or the split extends over two pitches ($2 \times P$) of the sprocket holes 24.

In the arrangements shown in FIG. 4D and FIGS. 19A and 19B, two or more sprocket sensors are spaced apart by a distance which is an integral multiple (n equal to or smaller than 1) of the pitch P of the sprocket holes 24. Such a configuration is not necessary when the sensors each is positioned such that light issuing therefrom is incident obliquely, i.e., not perpendicularly to the CF paper 10. The gist is that the sprocket sensors sense different sprocket holes 24 at the same time. Of course, the sprocket sensors may be so positioned as to sense sprocket holes arranged along the other edge of the CF paper 10.

While the present invention has been shown and described in relation to an electrophotographic copier, it is of course applicable to a digital copier or similar image forming apparatus in the same manner.

In summary, in accordance with the present invention, even when sprocket holes formed through CF paper are deformed or otherwise damaged, the transport and stop of the paper can be controlled with the sprocket holes being surely sensed. Since sensors responsive to the sprocket holes do not have to be shifted in matching relation to the paper size, the structure is simple.

Various modifications will become possible for those skilled in the art after receiving the teachings of the present disclosure without departing from the scope thereof.

What is claimed is:

1. An automatic document feeder (ADF) for an image recorder having a top open platen, comprising:

document transporting means located to face the platen for transporting a continuous document constituted by a sequence of continuous pages and having a plurality of equally spaced feed holes;

hole sensor means comprising a plurality of hole sensors each of which generate feed pulses by detecting different ones of said feed holes simultaneously;

decision means for producing, on receiving said feed pulses from said plurality of hole sensors at the same time, a feed pulse by determining that said hole sensors each has sensed a single hole, said decision means comprising an AND gate which receives pulses from at least two of the plurality of hole sensors and which outputs feed pulses to said counting means representing sensing of different holes by said at least two sensors such that an output of said decision means corresponding to sensing of a hole is provided only when each of said at least two hole sensors has sensed a hole;

counting means for counting said feed pulses from said decision means; and control means for controlling said document transporting means such that when said counting means reaches a count matching one page of the continuous document, said document transporting means stops transporting said continuous document.

2. An ADF as claimed in claim 1, wherein said document transporting means comprises a motor constituting a drive source for transporting the continuous document, motor driving means for controllably driving said motor, and document feed commanding means for delivering a feed command to said motor driving means for transporting said continuous document.

3. An ADF as claimed in claim 1, wherein said hole sensors each comprises a light emitting element and a light sensitive-element which are constituted by a photodiode and a phototransistor, respectively.

4. An ADF as claimed in claim 1, wherein the continuous document comprises computer form paper.

5. An ADF as claimed in claim 1, further comprising sheet-like document feeding means for feeding sheet-like documents to the platen, each of said sheet-like documents having a predetermined size.

6. The ADF of claim 1, wherein said plurality of hole sensors are longitudinally spaced in a feeding direction of said continuous document.

* * * * *